US011367393B2

(12) United States Patent
Yana et al.

(10) Patent No.: US 11,367,393 B2
(45) Date of Patent: Jun. 21, 2022

(54) DISPLAY PANEL, DRIVING METHOD THEREOF AND DISPLAY DEVICE

(71) Applicants: Wuhan Tianma Micro-Electronics Co., Ltd., Wuhan (CN); Wuhan Tianma Microelectronics Co., Ltd. Shanghai Branch, Shanghai (CN)

(72) Inventors: Gao Yana, Shanghai (CN); Xinzhao Liu, Shanghai (CN); Yue Li, Shanghai (CN); Xingyao Zhou, Shanghai (CN); Minfu Zhang, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 17/011,944

(22) Filed: Sep. 3, 2020

(65) Prior Publication Data

US 2020/0402458 A1 Dec. 24, 2020

(30) Foreign Application Priority Data

Jun. 28, 2020 (CN) ..... 202010601691.6

(51) Int. Cl.
*G09G 3/3233* (2016.01)

(52) U.S. Cl.
CPC ... *G09G 3/3233* (2013.01); *G09G 2300/0426* (2013.01); *G09G 2320/02* (2013.01); *G09G 2330/00* (2013.01)

(58) Field of Classification Search
CPC .. G09G 3/3208; G09G 3/3233; G09G 3/3258; G09G 2300/0426; G09G 2300/0819; G09G 2300/0842; G09G 2300/0852; G09G 2300/0861;
(Continued)

(56) References Cited

U.S. PATENT DOCUMENTS

2008/0012804 A1* 1/2008 Kim ..... G09G 3/3275 345/82
2009/0079678 A1* 3/2009 Ozawa ..... G09G 3/3233 345/77
(Continued)

FOREIGN PATENT DOCUMENTS

CN 106548753 A 3/2017
CN 209168713 U 7/2019
KR 10145091 B1 10/2014

*Primary Examiner* — Mihir K Rayan
(74) *Attorney, Agent, or Firm* — Alston & Bird LLP

(57) ABSTRACT

Provided are a display panel, a driving method thereof and a display device. The display panel includes a substrate, multiple sub-pixels located on one side of the substrate, and at least one signal conversion circuit. Each sub-pixel includes a pixel driving circuit and a light-emitting element. The pixel driving circuit includes an initialization transistor and a driving transistor. A first electrode of the initialization transistor is electrically connected to a gate of the driving transistor. The signal conversion circuit may convert a received initialization signal to a first initialization signal or convert the initialization signal to a second initialization signal according to a received data control signal, and generate an output of the conversion to the second electrode of the initialization transistor. This can avoid an unstable gate voltage of the driving transistor caused by a leakage current, further improve the display effect.

20 Claims, 14 Drawing Sheets

(58) Field of Classification Search
CPC ..... G09G 2300/0871; G09G 2320/02; G09G 2320/045; G09G 2330/00
See application file for complete search history.

(56) References Cited

U.S. PATENT DOCUMENTS

2009/0174630 A1* 7/2009 Chan ..... H01L 51/5284 345/76
2015/0130865 A1* 5/2015 Shim ..... G09G 3/3233 345/694
2016/0049113 A1* 2/2016 Park ..... G09G 3/3208 345/212
2016/0078808 A1* 3/2016 Lin ..... G09G 3/3233 345/690

* cited by examiner

DISPLAY PANEL, DRIVING METHOD THEREOF AND DISPLAY DEVICE

CROSS-REFERENCE TO RELATED APPLICATIONS

This application claims priority to Chinese patent application No. 202010601691.6 filed with CNIPA on Jun. 28, 2020, the disclosure of which is incorporated herein by reference in its entirety.

TECHNICAL FIELD

Embodiments of the present disclosure relate to the field of display technologies and, in particular, to a display panel, a driving method thereof and a display device.

BACKGROUND

An organic light-emitting diode (OLED) display panel has a wide application prospect because of the advantages, such as the self-luminous, the high contrast, the small thickness, the fast reaction speed, being applicable to a flexural panel and etc.

An OLED element of the OLED display panel is a current-driven element, and a corresponding pixel driving circuit is disposed for providing a driving current to the OLED element, so that the OLED element can emit light. The pixel driving circuit of the OLED display panel usually includes a driving transistor, an initialization transistor, a storage capacitor and the like. The driving transistor can generate the driving current according to the gate voltage of the driving transistor so as to drive the OLED element. The gate of the driving transistor is electrically connected to the initialization transistor. Due to characteristics of the transistors, the gate voltage of the driving transistor can be unstable because gate charges may leak through the initialization transistor, thereby affecting the luminous brightness of the light-emitting element and further affecting the display effect.

SUMMARY

The present disclosure provides a display panel, a driving method thereof and a display device, which can reduce gate leakage current and avoid an unstable gate voltage of a driving transistor, thereby improving the display effect.

In an embodiment, the present disclosure provides a display panel. The display panel includes a substrate, multiple sub-pixels located on one side of the substrate and at least one signal conversion circuit.

The multiple sub-pixels are arranged in an array, each of the multiple sub-pixels includes a pixel driving circuit and a light-emitting element. The pixel driving circuit includes an initialization transistor and a driving transistor. A first electrode of the initialization transistor is electrically connected to a gate of the driving transistor. The driving transistor is configured to provide a driving current to the light-emitting element according to a data signal.

An input end of each of the at least one signal conversion circuit receives an initialization signal. A control end of each of the at least one signal conversion circuit receives a data control signal. An output end of each of the at least one signal conversion circuit is electrically connected to a second electrode of the initialization transistor. The at least one signal conversion circuit is configured to convert the initialization signal to a first initialization signal, or convert, according to the data control signal, the initialization signal to a second initialization signal, and generate an output of the conversion to the second electrode of the initialization transistor.

A voltage difference between the data control signal and the data signal is within a first preset range. A voltage difference between the second initialization signal and a gate potential of the driving transistor is within a second preset range.

In an embodiment, the present disclosure further provides a method of driving the display panel according to the embodiments of the present disclosure and the method includes steps described below.

In an initialization stage, each of the at least one signal conversion circuit converts the initialization signal to the first initialization signal, and writes the first initialization signal to the second electrode of the initialization transistor; and the initialization transistor writes the first initialization signal into the gate of the driving transistor.

In a light-emitting stage, the initialization transistor is turned off, and the driving transistor drives the light-emitting element to emit light according to the data signal; and each of the at least one signal conversion circuit converts the initialization signal to the second initialization signal according to the data control signal, and outputs the second initialization signal to the second electrode of the initialization transistor, so that the voltage difference between the second electrode of the initialization transistor and the first electrode of the initialization transistor is within the second preset range.

In an embodiment, the present disclosure further provides a display device. The display device includes the display panel according to the embodiments of the present disclosure.

BRIEF DESCRIPTION OF DRAWINGS

Other features, objects and advantages of the present disclosure will become more apparent after a detailed description of non-restrictive embodiments with reference to the drawings is read.

DETAILED DESCRIPTION

To make the objects, technical schemes and advantages of the present disclosure clearer, the technical schemes of the present disclosure are described below in detail in conjunction with the embodiments and the drawings in the embodiments of the present disclosure. Apparently, the described embodiments are part, not all, of embodiments of the present disclosure, and based on the embodiments of the present disclosure, other embodiments obtained by those skilled in the art on the premise that no creative work is done are within the scope of the present disclosure.

Figure 1:
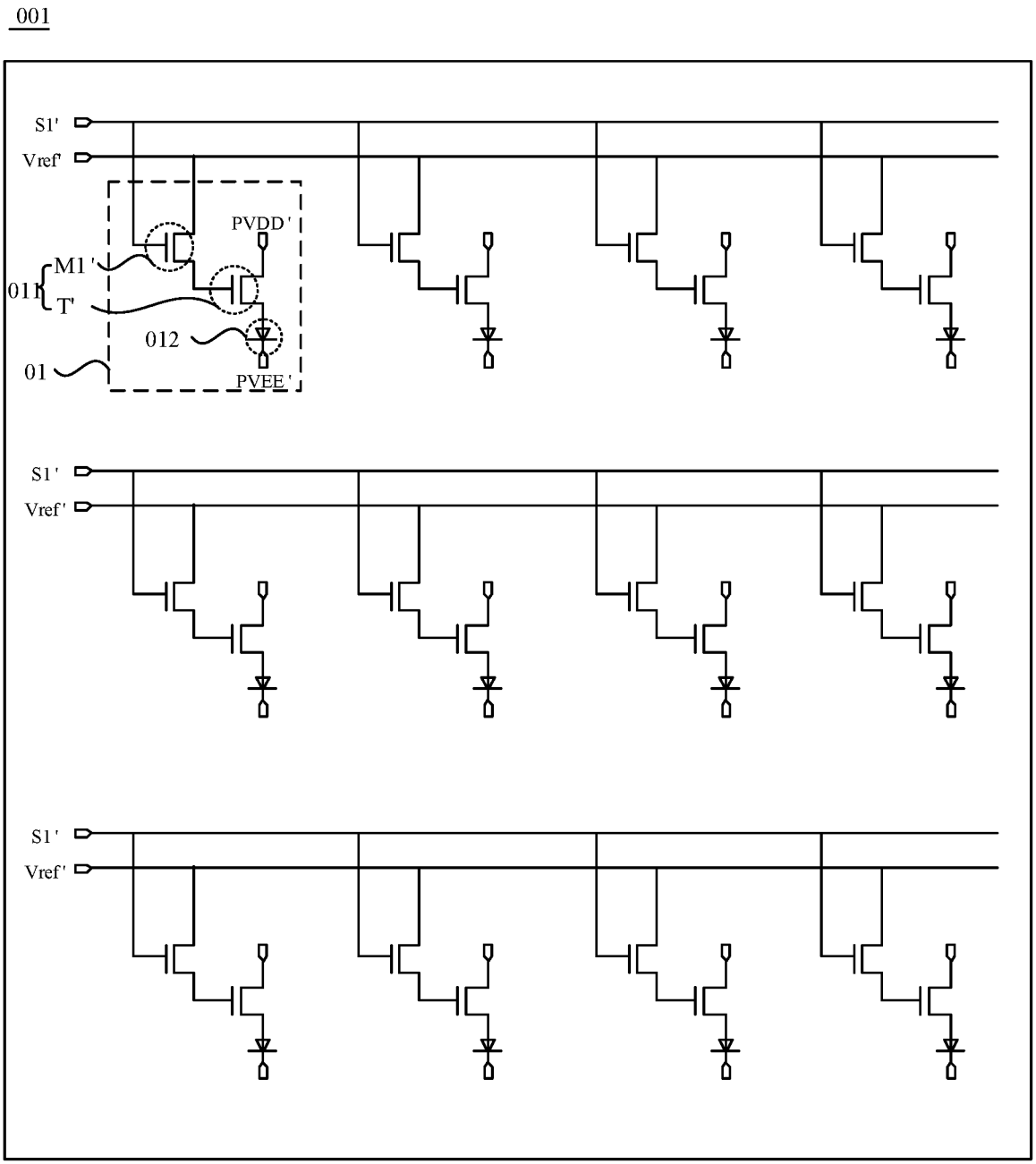
FIG. 1 is a circuit diagram of a display panel according to a related art.

FIG. 1 is a circuit diagram of a display panel according to the related art. As shown in FIG. 1, the display panel 001 in the related art includes multiple sub-pixels 01 arranged in an array. Each sub-pixel 01 includes a pixel driving circuit 011 and a light-emitting element 012. The pixel driving circuit 011 includes an initialization transistor M1' and a driving transistor T'. A first electrode of the initialization transistor M1' is electrically connected to a gate of the driving transistor T' and the first electrode of the initialization transistor M1' receives an initialization signal Vref', so that in an initialization stage, the initialization transistor M1' is turned on under the control of a scanning signal S1' received by a gate of the initialization transistor M1', and the initialization signal Vref is written into the gate of the driving transistor T' through the turned-on initialization transistor M1' to initialize the driving transistor T'. In a light-emitting stage, a gate signal of the driving transistor T' becomes a signal related to a data signal for controlling the luminous brightness of the light-emitting element 012, and at the same time, the first electrode of the driving transistor T' will receive a first power voltage signal PVDD', a second electrode of the driving transistor T' is electrically connected to an anode of the light-emitting element 012, and a cathode of the light-emitting element 012 receives a second power voltage signal PVEE'. The second power voltage signal PVEE' has a voltage smaller than that of the first power voltage signal PVDD', so that the driving transistor T' can generate a corresponding driving current according to the data signal to drive the light-emitting element 012 to emit light.

However, due to characteristics of the transistors, even if the gate signal of the initialization transistor M1' controls the initialization transistor M1' to be in a turned-off state, when there is a relatively large voltage difference between the first electrode and the second electrode of the initialization transistor M1', a leakage current from a high potential node to a potential node is generated, that is, a corresponding leakage current flows through the initialization transistor M1', so that a gate potential of the driving transistor T' electrically connected to the first electrode of the initialization transistor M1' varies, which leads to variations of the driving current generated by the driving transistor T' according to the gate potential of the driving transistor T', thereby affecting the luminous brightness of the light-emitting element 012 and further affecting the display effect of the display panel.

The embodiments of the present disclosure provide a display panel. The display panel includes a substrate, multiple sub-pixels located on one side of the substrate and at least one signal conversion circuit. The multiple sub-pixels are arranged in an array, and each sub-pixel includes a pixel driving circuit and a light-emitting element. The pixel driving circuit includes an initialization transistor and a driving transistor. A first electrode of the initialization transistor is electrically connected to a gate of the driving transistor. The driving transistor is configured to provide a driving current to the light-emitting element according to a data signal. An input end of a signal conversion circuit receives an initialization signal, a control end of the signal conversion circuit receives a data control signal, and an output end of the signal conversion circuit is electrically connected to a second electrode of the initialization transistor. The at least one signal conversion circuit is configured to convert the initialization signal to a first initialization signal, or convert the initialization signal to a second initialization signal according to the data control signal, and output one of the first initialization signal or the second initialization signal to the second electrode of the initialization transistor. A voltage difference between the data control signal and the data signal is within a first preset range. A voltage difference between the second initialization signal and a gate potential of the driving transistor is within a second preset range.

According to the preceding technical scheme, on the one hand, the at least one signal conversion circuit is disposed in the display panel, and the at least one signal conversion circuit is configured to convert the initialization signal to the first initialization signal, or convert the initialization signal to the second initialization signal according to the data control signal. Thus, in an initialization stage, each signal conversion circuit may output the first initialization signal to the second electrode of the initialization transistor, and write the first initialization signal into the gate of the driving transistor through the turned-on initialization transistor to initialize the driving transistor; and in a light-emitting stage, each signal conversion circuit may output the second initialization to the second electrode of the initialization transistor, and since the voltage difference between the data control signal and the data signal written into the gate of the transistor is within the first preset range, the voltage difference between the gate potential of the driving transistor and the second initialization signal converted by each signal conversion circuit according to the data control signal is within the second preset range in the light-emitting stage, so that there is a relatively small voltage difference between the second electrode of the initialization transistor and the gate of the driving transistor, thereby reducing the leakage current caused by the voltage difference between the second electrode of the initialization transistor and the gate of the driving transistor, avoiding an unstable gate voltage of the driving transistor caused by the leakage current, and further improving the display effect. On the other hand, in the light-emitting stage, the driving transistor may provide the corresponding driving current to the light-emitting element according to the data signal written into the gate of the driving transistor, so as to control the light-emitting element to emit light; at this time, the signal conversion circuit may output the corresponding second initialization signal to the second electrode of the initialization transistor according to the data control signal received by the control end of the signal conversion circuit, and the data control signal is related to the data signal written into the gate of the driving transistor, so that when different data signals are written into the gate of the driving transistor, the signal conversion circuit outputs different second initialization signals to adjust the second initialization signal transmitted to the second electrode of the initialization transistor for the different data signals; and in this way, even if different data signals are written into the gate of the driving transistor, the voltage difference between of the second electrode of the initialization transistor and the gate of the driving transistor can be ensured to remain within the second preset range, thereby improving the display quality of dynamic images of the display panel. Meanwhile, the signal conversion circuit may directly provide the corresponding second initialization signal according to the data control signal related to the data signal written into the gate of the driving transistor, so that the voltage difference between the second electrode of the initialization transistor and the gate of the driving transistor can be more accurately controlled to be within the second preset range, further improving the display quality of the display panel.

The above is the core idea of the present disclosure, and technical schemes in the embodiments of the present disclosure will be described clearly and completely in conjunction with the drawings in the embodiments of the present disclosure. Based on the embodiments of the present disclosure, all other embodiments obtained by those skilled in the art without creative work are within the scope of the present disclosure.

In the embodiments of the present disclosure, at least one signal conversion circuit is disposed in the display panel, that is, one, two or more signal conversion circuits may be disposed in the display panel. The number of signal conversion circuits disposed in the display panel is not limited in the embodiments of the present disclosure on the premise that the core inventive points of the embodiments of the present closure may be implemented.

Figure 2:
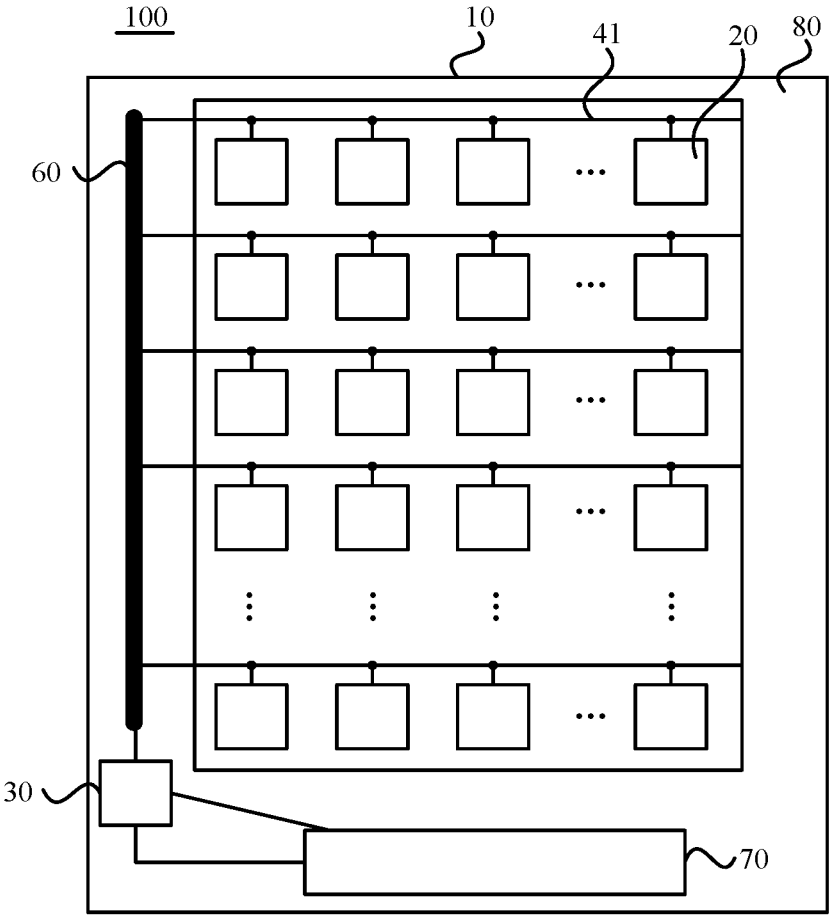
FIG. 2 is a block diagram of a display panel according to an embodiment of the present disclosure.
Figure 3:
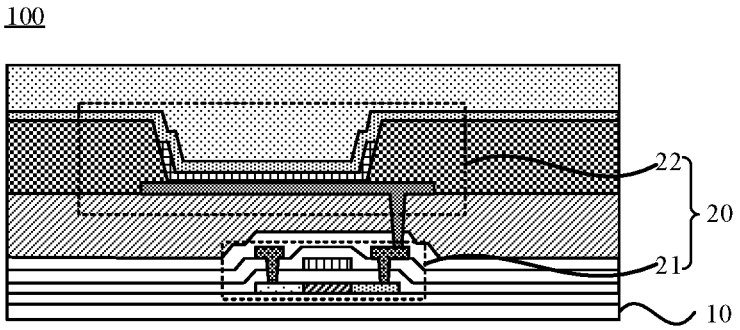
FIG. 3 is a cross sectional view of a display panel according to an embodiment of the present disclosure.
Figure 4:
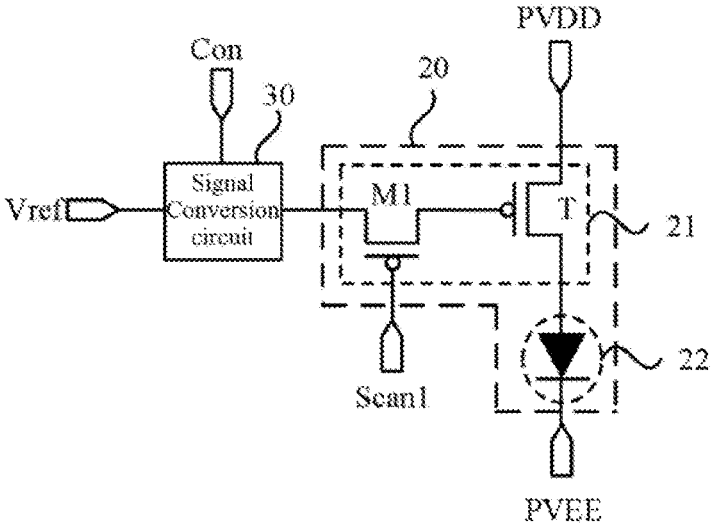
FIG. 4 is a circuit diagram of a sub-pixel according to an embodiment of the present disclosure.

FIG. 2 is a block diagram of a display panel according to an embodiment of the present disclosure. FIG. 3 is a cross sectional view of a film structure of a display panel according to an embodiment of the present disclosure. FIG. 4 is a circuit diagram of a sub-pixel according to an embodiment of the present disclosure. In conjunction with FIGS. 2, 3 and 4, the display panel 100 includes a substrate 10, multiple sub-pixels 20 located on one side of the substrate, and a signal conversion circuit 30. Each sub-pixel includes a pixel driving circuit 21 and a light-emitting element 22. The pixel driving circuit 21 includes an initialization transistor M1 and a driving transistor T. A first electrode of the initialization transistor M1 is electrically connected to a gate of the driving transistor T. The driving transistor T may be configured to provide a driving current to the light-emitting element 22 according to a data signal to control the light-emitting element 22 to emit light. An input end of the signal conversion circuit 30 receives an initialization signal Vref, and a control end of the signal conversion circuit 30 receives a data control signal Con, and an output end of the signal conversion circuit 30 is electrically connected to a second electrode of the initialization transistor M1. The signal conversion circuit may convert the initialization signal Vref to a first initialization signal, or convert the initialization signal Vref to a second initialization signal according to a data control signal Con, and output one of the converted first initialization signal or the converted second initialization signal to the second electrode of the initialization transistor M1.

Thus, in an initialization stage of each sub-pixel, the signal conversion circuit 30 may directly convert the initialization signal Vref received by the input end of the signal conversion circuit 30 to the fixed first initialization signal, and write the first initialization signal into the gate of the driving transistor T of the each sub-pixel 20 through the turned-on initialization transistor M1 in the each sub-pixel 20 to initialize the driving transistor T of the each sub-pixel 20. At least when all multiple sub-pixels 20 are in a light-emitting stage, the signal conversion circuit 30 may convert the initialization signal Vref to the second initialization signal according to the data control signal Con and output the second initialization signal to the second electrode of the initialization transistor M1 of the each sub-pixel 20. The voltage difference between the data control signal Con received by the control end of the signal conversion circuit 30 and the data signal written into the each sub-pixel 20 is within a first preset range. For example, when a frame of image is displayed, a corresponding data signal is respectively written into the gate of the driving transistor T of each sub-pixel 20 so that the driving transistor T provides a corresponding driving current to the light-emitting element 22 according to the data signal written into the gate of the driving transistor T, so as to control the light-emitting element 22 to emit light. At this time, a corresponding data control signal Con may be generated according to an average value of data signals provided to the multiple sub-pixels 20, so that the voltage difference between the gate of the driving transistor T and a second initialization signal converted by the signal conversion circuit 30 according to the data control signal Con is within the second preset range, and thus, the voltage difference between the first electrode of the initialization transistor M1 and the gate of the driving transistor T can be controlled to be within the second preset range, so as to reduce a leakage current caused by the voltage difference between the first electrode of the initialization transistor M1 and the gate of the driving transistor and reduce the impact on a gate potential of the driving transistor T, thereby improving the phenomenon where the luminance brightness of the light-emitting element 22 is affected by variations of the gate potential of the driving transistor T, and further improving the display effect of the display panel 100.

Additionally, the display luminance of the light-emitting element 22 of each sub-pixel 20 is related to the driving current provided by the driving transistor T, while the driving current provided by the driving transistor T is related to the data signal written into the gate of the driving transistor T, so when data signals of a same frame of image which are respectively written into gates of driving transistors T of the multiple sub-pixels 20 have differences, light-emitting elements 22 of the multiple sub-pixels 20 in the display panel have different luminance brightness. In this case, the voltage magnitude of the data control signal Con may be determined according to the luminance brightness of the light-emitting element 22 in the multiple sub-pixels. For example, when sub-pixels 20 having light-emitting elements 22 with high display brightness has a larger number than sub-pixels 20 having light-emitting elements 22 with low display brightness in a same frame of image, a corresponding data control signal Con may be generated according to data signals of the sub-pixels 20 with the high display brightness. In this case, at least when all the multiple sub-pixels 20 in the display panel 100 are in the light-emitting stage, the signal conversion circuit 30 may output the second initialization signal to the second electrode of the initialization transistor M1 of each sub-pixel according to the data control signal Con, so that there is a relatively small voltage difference between the gate of the driving transistor T and the first electrode of the initialization transistor M1 in each of most sub-pixels 20 in the display panel, so as to reduce the leakage current caused by the voltage difference between the gate of the driving transistor and the first electrode of the initialization transistor M1 in the each of the most sub-pixels 20, thereby improving the overall display effect of the display panel 100. On the contrary, when the sub-pixels 20 having light-emitting elements 22 with low display brightness has a larger number than the sub-pixels 20 having light-emitting elements 22 with high display brightness in the same frame of image, the corresponding data control signal Con may be generated according to data signals of the sub-pixels 20 with low display brightness. The technical principle in this case is similar to that in the case of generating the corresponding data control signal Con according to the data signals of the sub-pixels 20 having high display brightness, which will not be repeated here.

Accordingly, the signal conversion circuit 30 may output the corresponding second initialization signal to the second electrode of the initialization transistor M1 according to the data control signal Con received by the control end of the signal conversion circuit 30, and the data control signal Con is related to the data signal written into the gate of the driving transistor T, so that when different data signals are written into the gate of the driving transistor T, the signal conversion circuit 30 outputs different second initialization signals, so as to adjust the second initialization signal transmitted to the second electrode of the initialization transistor M1 for the different data signals. Thus, even if data signals written into the gate of the driving transistor T have differences, the voltage difference between of the second electrode of the initialization transistor M1 and the gate of the driving transistor T can be ensured to remain within the second preset range, thereby improving the display quality of dynamic images of the display panel 100. Meanwhile, the signal conversion circuit 30 may directly provide the corresponding second initialization signal according to the data control signal related to the data signal Con written into the gate of the driving transistor T, so that the voltage difference between the second electrode of the initialization transistor M1 and the gate of the driving transistor T can be more accurately controlled to be within the second preset range, further improving the display quality of the display panel 100.

It is be noted that FIG. 2 is only an exemplary drawing of the embodiments of the present disclosure, and only some a part of the multiple sub-pixels, signal lines and the like are exemplarily shown in FIG. 2. Moreover, the symbol " . . . " in the structural schematic diagram of the display panel in real time according to the present disclosure may be omitted sub-pixels, signal lines and the like. The structure of the display panel is not limited in the embodiments of the present disclosure on the premise that the core inventive points of the embodiments of the present disclosure can be implemented.

Additionally, FIG. 2 further shows an initialization signal bus 60 disposed on the one side of the substrate, multiple initialization signal lines 41 disposed on the one side of the substrate and multiple data pins 70 disposed on the one side of the substrate. In this case, the input end of the signal conversion circuit 30 may be electrically connected to a data pin 70 to receive the initialization signal, the control end of the signal conversion circuit 30 may be electrically connected to another data pin 70 to receive the corresponding data control signal, and the output end of the signal conversion circuit 30 may be electrically connected to each initialization signal line 41 through the initialization signal bus 60. Accordingly, second electrodes of initialization transistors in a same row of sub-pixels 20 may be electrically connected to a same initialization signal line 41, so that the first initialization signal or the second initialization signal converted by the signal conversion circuit 30 may be transmitted to the second electrodes of the initialization transistors in the same row of sub-pixels 20 sequentially through the initialization signal bus 60 and the same initialization signal line 41. Thus, in the initialization stage of each sub-pixel, the gate of the driving transistor of each sub-pixel 20 is initialized, and at least when all the multiple sub-pixels in the display panel are in the light-emitting stage, the voltage difference between the second electrode of the initialization transistor and the gate of the driving transistor can be controlled to be within the second preset range, so as to reduce the leakage current caused by the voltage difference between the second electrode of the initialization transistor M1 and the gate of the driving transistor and reduce the impact on the gate potential of the driving transistor T which is electrically connected to the first electrode of the initialization transistor M1, thereby improving the phenomenon where the luminance brightness of the light-emitting element 22 is affected by the variations of the gate potential of the driving transistor T, and further improving the display effect of the display panel 100.

It is to be noted that in the schematic diagram of the film structure of the display panel 100 shown in FIG. 3, the display panel 100 is top emitting, that is, the light-emitting element 22 is located on a side of the pixel driving circuit 21 away from the substrate; and in the embodiments of the present disclosure, the display panel may be bottom emitting, that is, the light-emitting element 22 is located on a side of the pixel driving circuit 21 adjacent to the substrate; which is not limited in the embodiments of the present disclosure.

Additionally, FIG. 4 exemplarily illustrates that the pixel driving circuit of each sub-pixel includes the initialization transistor M1 and the driving transistor T, and in the embodiments of the present disclosure, the pixel driving circuit may include other components.

Figure 5:
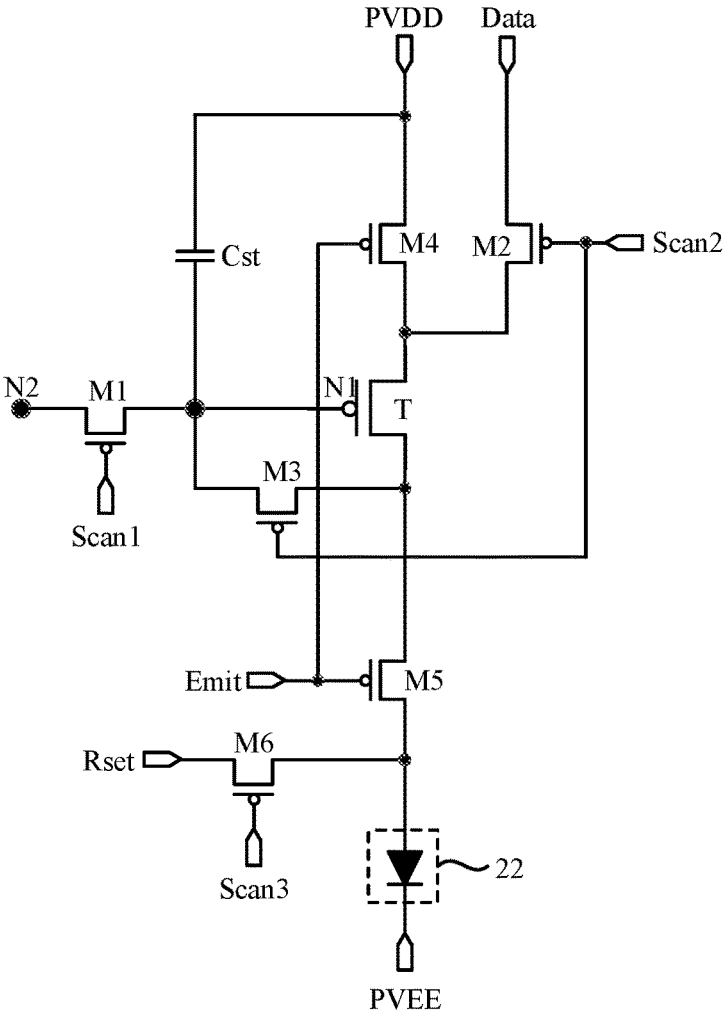
FIG. 5 is a circuit diagram of another sub-pixel according to an embodiment of the present disclosure.

Exemplarily, FIG. 5 is a circuit diagram of another sub-pixel according to an embodiment of the present disclosure. As shown in FIG. 5, a pixel driving circuit of each sub-pixel includes seven transistors and a storage capacitor Cst. The seven transistors are a driving transistor T, an initialization transistor M1, a data writing transistor M2, a threshold compensation transistor M3, a first light-emitting control transistor M4, a second light-emitting control transistor M5 and a reset transistor M6 respectively. A gate of the initialization transistor M1 receives a first scanning signal Scan1, and the initialization transistor M1 is turned on or off under the control of the first scanning signal Scan1. When the first scanning signal Scan1 controls the initialization transistor M1 to be turned on, the first initialization signal received by the second electrode N2 of the initialization transistor M1 is written into a gate of the driving transistor T electrically connected to a first electrode N1 of the initialization transistor M1, so as to initialize the driving transistor T. A gate of the data writing transistor M2 and a gate of the threshold compensation transistor M3 both receives a second scanning signal Scan2, so that the gate of the data writing transistor M2 and the threshold compensation transistor M3 may be turned on or off under the control of the second scanning signal Scan 2. A first electrode of the data writing transistor M2 receives a data signal Data, and a second electrode of the data writing transistor M2 is electrically connected to a first electrode of the driving transistor T. A first electrode of the threshold compensation transistor M3 is electrically connected to a second electrode of the driving transistor T, and a second electrode of the threshold compensation transistor M3 is electrically connected to the gate of the driving transistor T, so that when the second scanning signal Scan2 controls the gate of the data writing transistor M2 and the threshold compensation transistor M3 to be turned on, the data signal Data received by the data writing transistor M2 may be written into the gate of the driving transistor T, and a gate potential of the driving transistor T is related to a threshold voltage of the driving transistor T. A gate of the first light-emitting control transistor M4 and a gate of the second light-emitting control transistor M5 both receives a light-emitting control signal Emit, so that the first light-emitting control transistor M4 and the second light-emitting control transistor M5 may be turned on or off under the control of the light-emitting control signal Emit. A first electrode of the first light-emitting control transistor M4 receives a first power voltage signal PVDD, and a second electrode of the first light-emitting control transistor M4 is electrically connected to the first electrode of the driving transistor T. A first electrode of the second light-emitting control transistor M5 is electrically connected to the second electrode of the driving transistor T, and a second electrode of the second light-emitting control transistor M5 is electrically connected to an anode of the light-emitting element 22. A cathode of the light-emitting element 22 receives a second power voltage signal PVEE. The first power voltage signal PVDD is different from the second power voltage signal PVEE, so that when the light-emitting control signal Emit controls the first light-emitting control transistor M4 and the second light-emitting control transistor M5 to be turned on, a loop is formed between the first electrode of the first light-emitting control transistor M4 that receives the first power voltage signal PVDD and the cathode of the light-emitting element 22 that receives the second power voltage signal PVEE, and a driving current generated by the driving transistor T according to the data signal Data flows into the light-emitting element 22 and controls the light-emitting element 22 to emit light.

Additionally, a gate of the reset transistor M6 receives a third scanning signal Scan3 and the gate of the reset transistor M6 is turned on or off under the control of the third scanning signal Scan3. A first electrode of the reset transistor M6 receives a reset signal Rset, and a second electrode of the reset transistor M6 is electrically connected to the anode of the light-emitting element 22, so that when the third scanning signal Scan3 controls the reset transistor M6 to be turned on, the reset signal Rset may be provided to the anode of the light-emitting element 22 to reset the anode of the light-emitting element 22. The third scanning signal Scan3 may be same as the first scanning signal Scan1, and the reset signal Rset may be same as the first initialization signal.

It is to be noted that FIG. 5 is only an exemplary drawing of the embodiments of the present disclosure, and the pixel driving circuit of each sub-pixel in FIG. 5 includes seven transistors and one capacitor; however, for the display panel according to the embodiments of the present disclosure, the structure of the pixel driving circuit of each sub-pixel is not limited in the embodiments of the present disclosure on the premise that the pixel driving circuit of each sub-pixel includes the initialization transistor and the driving transistor. For ease of description, the embodiments of the present disclosure are all illustrated by using the pixel driving circuit shown in FIG. 5 as an example.

Additionally, each transistor in the pixel driving circuit shown in FIG. 5 is a P-type transistor, and each transistor in the pixel driving circuit may be an N-type transistor in the embodiments of the present disclosure, which is not limited in the embodiments of the present disclosure. Using the example where the pixel driving circuit is 7T1C (seven transistors and one storage capacitor) and each transistor of the pixel driving circuit is a P-type transistor, the principle in the case where only one signal conversion circuit is provided in the display panel is described below in details.

Figure 6:
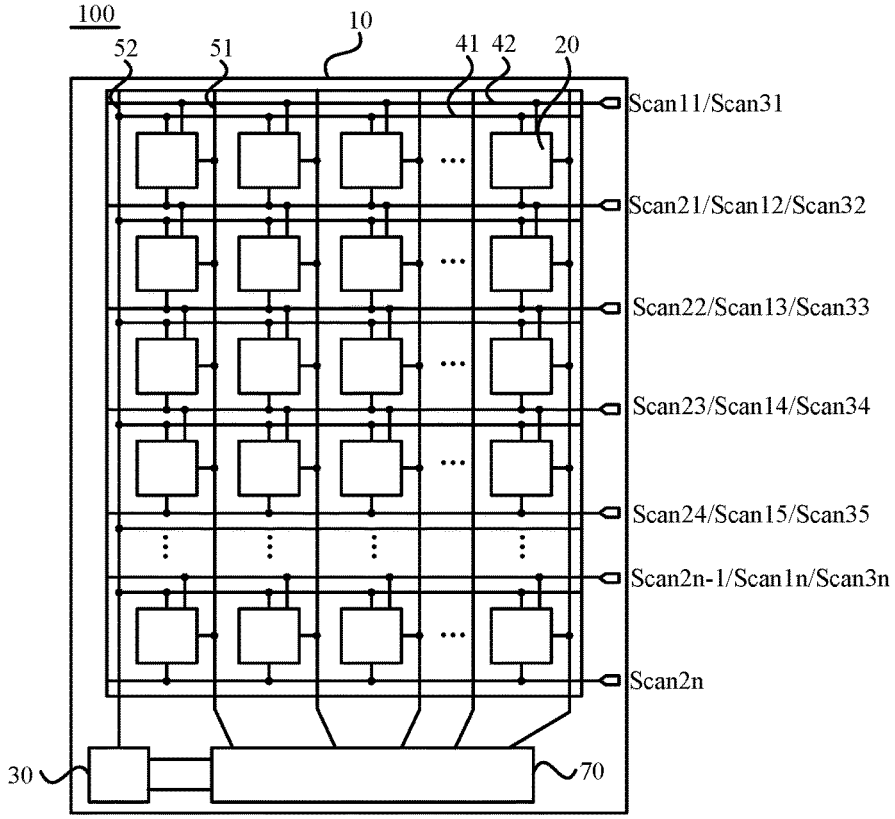
FIG. 6 is a block diagram of another display panel according to an embodiment of the present disclosure.
Figure 7:
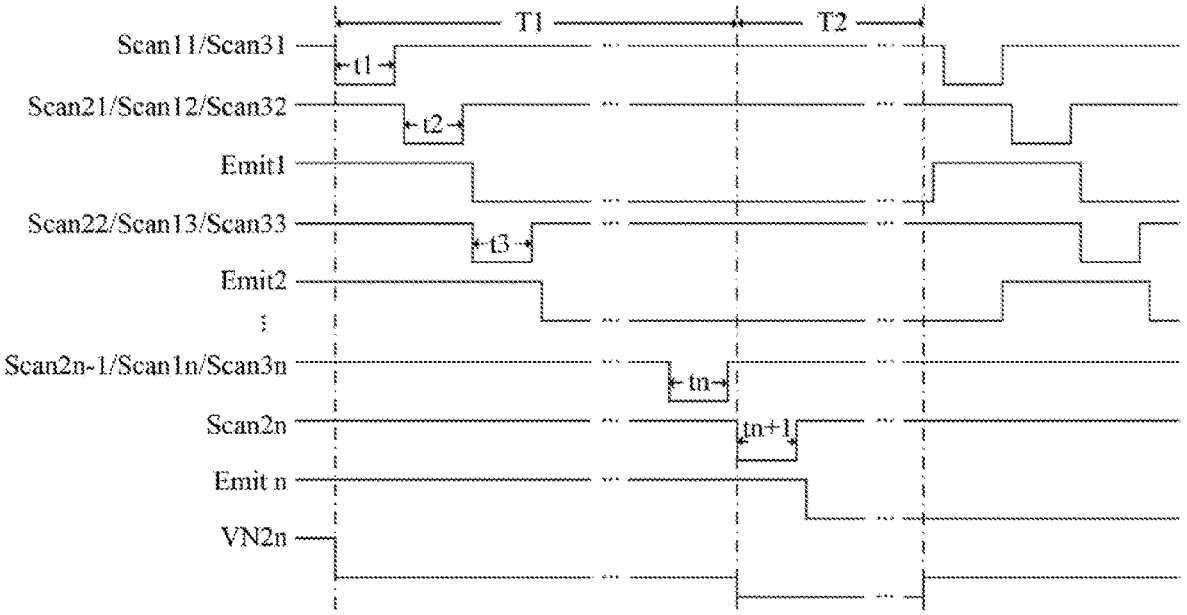
FIG. 7 is a driving timing diagram of a display panel according to an embodiment of the present disclosure.

FIG. 6 is a block diagram of another display panel according to an embodiment of the present disclosure. FIG. 7 is a driving timing diagram of a display panel according to an embodiment of the present disclosure. In conjunction with FIGS. 5, 6 and 7, in the case where a display panel 100 includes N*M sub-pixels, the display panel 100 may include a data control line 52, multiple initialization signal lines 41, multiple scanning signal lines 42 and multiple data signal lines 51. In this case, sub-pixels 20 located in a same column use a same data signal line 51, sub-pixels 20 located in a same row use a same initialization signal line 41, and the multiple initialization signal lines 41 may be electrically connected to the signal conversion circuit 30 through the data control line 52, so that a first initialization signal or a second initialization signal outputted by the signal conversion circuit 30 may be transmitted to a second electrode of an initialization transistor M1 of each sub-pixel sequentially through the data control line 52 and the multiple initialization signal lines 41. The sub-pixels 20 located in the same row may further use the same initialization signal line 41 and a same scanning signal line 42 in common. In two adjacent rows of sub-pixels, data writing transistors M2 and threshold compensation transistors M3 of sub-pixels in the previous row used a same scanning signal line 42 as initialization transistors M1 and reset transistors M6 of sub-pixels in the later row. That is, a first scanning signal Scan11 received by a gate of an initialization transistor M1 of a sub-pixel in a first row is same as a third scanning signal Scan31 received by a gate of a reset transistor M6 of this sub-pixel in the first row, a second scanning signal Scan21 received by a gate of the data writing transistor M2 and a gate of the threshold compensation transistor M3 of a sub-pixel in the first row is the same as a first scanning signal Scan12 received by a gate of an initialization transistor M1 and a third scanning signal Scan32 received by a gate of a reset transistor M6 of a sub-pixel in a second row; a second scanning signal Scan22 received by a gate of a data writing transistor M2 and a gate of a threshold compensation transistor M3 of a sub-pixel in the second row is the same as a first scanning signal Scan13 received by a gate of an initialization transistor M1 and a third scanning signal Scan33 received by a gate of a reset transistor M6 of a sub-pixel in a third row; a second scanning signal Scan23 received by a gate of a data writing transistor M2 and a gate of a threshold compensation transistor M3 of the sub-pixel in the third row is the same as a first scanning signal Scan14 received by a gate of an initialization transistor M1 and a third scanning signal Scan34 received by a gate of a reset transistor M6 of a sub-pixel in a fourth row; a second scanning signal Scan24 received by a gate of a data writing transistor M2 and a gate of a threshold compensation transistor M3 of the sub-pixel in the fourth row is the same as a first scanning signal Scan15 received by a gate of an initialization transistor M1 and a third scanning signal Scan35 received by a gate of a reset transistor M6 of a sub-pixel in a fifth row, . . . , a second scanning signal Scan2*n*-1 received by a gate of a data writing transistor M2 and a gate of a threshold compensation transistor M3 of a sub-pixel in an $(N-1)^{th}$ row is the same as a first scanning signal Scan1*n* received by a gate of an initialization transistor M1 and a third scanning signal Scan3*n* received by a gate of a reset transistor M6 of a sub-pixel in an $n^{th}$ row. In this way, a driving transistor T and an anode of a light-emitting element 22 of a sub-pixel in a later row may be initialized while a data signal is written into a gate of a driving transistor T of a sub-pixel in the previous row. The data control line 52 and the multiple data signal lines may be formed in a same fabrication process by using a same material, so as to simplify the fabrication process of the display panel, reduce the costs and improve the production efficiency.

When the display panel includes only one signal conversion circuit 30, a stage T1 in which the signal conversion circuit 30 outputs the first initialization signal may start from initializing driving transistors T of sub-pixels in the first row until an end of initializing driving transistors T of sub-pixels in the last row (the $N^{th}$ row), while a stage T2 in which the signal conversion circuit 30 outputs the second initialization signal may start from writing a data signal to gates of the driving transistors T of the sub-pixels in the last row until a restart of initializing the driving transistors T of the sub-pixels in the first row.

The stage T1 in which the signal conversion circuit 30 outputs the first initialization signal includes initialization stages of N rows of sub-pixels and data writing stages (t1, t2, t3, and tn) of N−1 rows of sub-pixels to sequentially control initialization transistors of sub-pixels in each row to be turned on, so that the first initialization signal VN2 outputted by the signal conversion circuit 30 may sequentially initialize driving transistors T of the sub-pixels in the each row through the turned-on initialization transistors M1. When the stage T2 in which the signal conversion circuit 30 outputs the second initialization signal starts, the data signal is written into gates of the driving transistors T of the sub-pixels in the $N^{th}$ row. At this time, light-emitting control signals Emit1, Emit2, . . . , and Emitn−1 which are sequentially provided to first N−1 rows of sub-pixels have controlled first light-emitting control transistors M4 and second light-emitting control transistors M5 of sub-pixels in the first N−1 rows to be turned on, and driving currents generated by the driving transistors T of the sub-pixels in the first N−1 rows according to the data signal written into the gates of the driving transistors T of the sub-pixels in the first N−1 rows are provided to anodes of light-emitting elements 22, so that the light-emitting elements 22 of the sub-pixels in the first N−1 rows emit light. Thus, the voltage difference between the second electrode N2 of the initialization transistor M1 and the gate N1 of the driving transistor T of each sub-pixel in the first N−1 rows can be kept within the second preset range, when the signal conversion circuit 30 outputs the second initialization signal VN2 to the second electrodes N2 of the initialization transistors M1 of the sub-pixels in each row. Meanwhile, after the data signal is written into the gates of the driving transistors T of the sub-pixels in the $N^{th}$ row, a light-emitting control signal Emitn provided to the sub-pixels in the $N^{th}$ row will control first light-emitting control transistors M4 and second light-emitting control transistors M5 of the sub-pixels in the $N^{th}$ row to be turned on, and driving currents generated by the driving transistors T of the sub-pixels in the $N^{th}$ row according to the data signal written into the gates of the driving transistors T of the sub-pixels in the $N^{th}$ row is provided to anodes of light-emitting elements 22 to control the light-emitting elements 22 of the sub-pixels in the $N^{th}$ row to emit light. At this time, the signal conversion circuit 30 outputs the second initialization signal VN2, so that the voltage difference between second electrodes N2 of initialization transistors M1 and the gates N1 of the driving transistors T of the sub-pixels in the $N^{th}$ row can be kept within the second preset range. When the driving transistors T of the sub-pixels in the first row are initialized again, the stage in which the signal conversion circuit 30 outputs the first initialization signal will restart.

It is to be noted that the driving timing of the display panel shown in FIG. 7 is only an exemplary driving timing sequences of the embodiments of the present disclosure. When only one signal conversion circuit 30 is disposed in the display panel 100, in FIG. 7, the time when the data signal is written into the gates of the driving transistors of the sub-pixels in the last row is used as the time when the signal conversion circuit 30 starts to output the second initialization signal. However, in the embodiments of the present disclosure, the time when the signal conversion circuit 30 starts to output the second initialization signal may be any time after the initialization of the driving transistors T of the sub-pixels in the last row completes, which is not limited in the embodiments of the present disclosure, so as to ensure that at least when all the multiple sub-pixels 20 are in the light-emitting stage, the second initialization signal outputted by the signal conversion circuit 30 can keep the voltage difference between the second electrode of the initialization transistor and the gate of the driving transistor T of each sub-pixel to be within the second preset range, thereby improving the display effect of the display panel.

It is to be noted that FIG. 7 of the present embodiment is a driving timing diagram only when each transistor in the pixel driving circuit shown in FIG. 5 is a P-type transistor. Generally, the P-type transistor is turned on under the control of a low level signal and is turned off under the control of a high level signal. In some alternative embodiments, each transistor in the pixel driving circuit may be an N-type transistor. Generally, the N-type transistor is turned on under the control of the high level signal and is turned off under the control of the low level signal. The type of each transistor in the pixel driving circuit is not limited in the embodiments of the present disclosure. Additionally, the symbol " . . . " in FIG. 7 is an omitted part of period instead of an interruption of the timing. The omitted part may be deduced by referring to a previous period and a later period, which will not be listed one by one in the embodiments of the present disclosure. Moreover, for the symbol " . . . " in a timing diagram of another embodiment of the present disclosure, refer to the explanation of the symbol " . . . " in FIG. 7, which will not be repeated below.

An exemplary description has been given by taking an example where one signal conversion circuit is disposed in the display panel. In the embodiments of the present disclosure, the display panel may be provided with multiple signal conversion circuits, such as each signal conversion circuit corresponds to a respective row of sub-pixels, corresponds to a respective column of sub-pixels, or corresponds to a respective sub-pixel in the display panel.

Alternatively, the one side of the substrate in the display panel is further provided with multiple initialization signal lines, the multiple initialization signal lines are arranged along a column direction, and each initialization signal line extends along a row direction. Second electrodes of initialization transistors of each row of sub-pixels are electrically connected to an output end of a same signal conversion circuit through a same initialization signal line. In this case, multiple signal conversion circuits may be disposed in the display panel, so that each signal conversion circuit may correspond to a respective row of sub-pixels, or each signal conversion circuit may correspond to multiple rows of sub-pixels.

Figure 8:
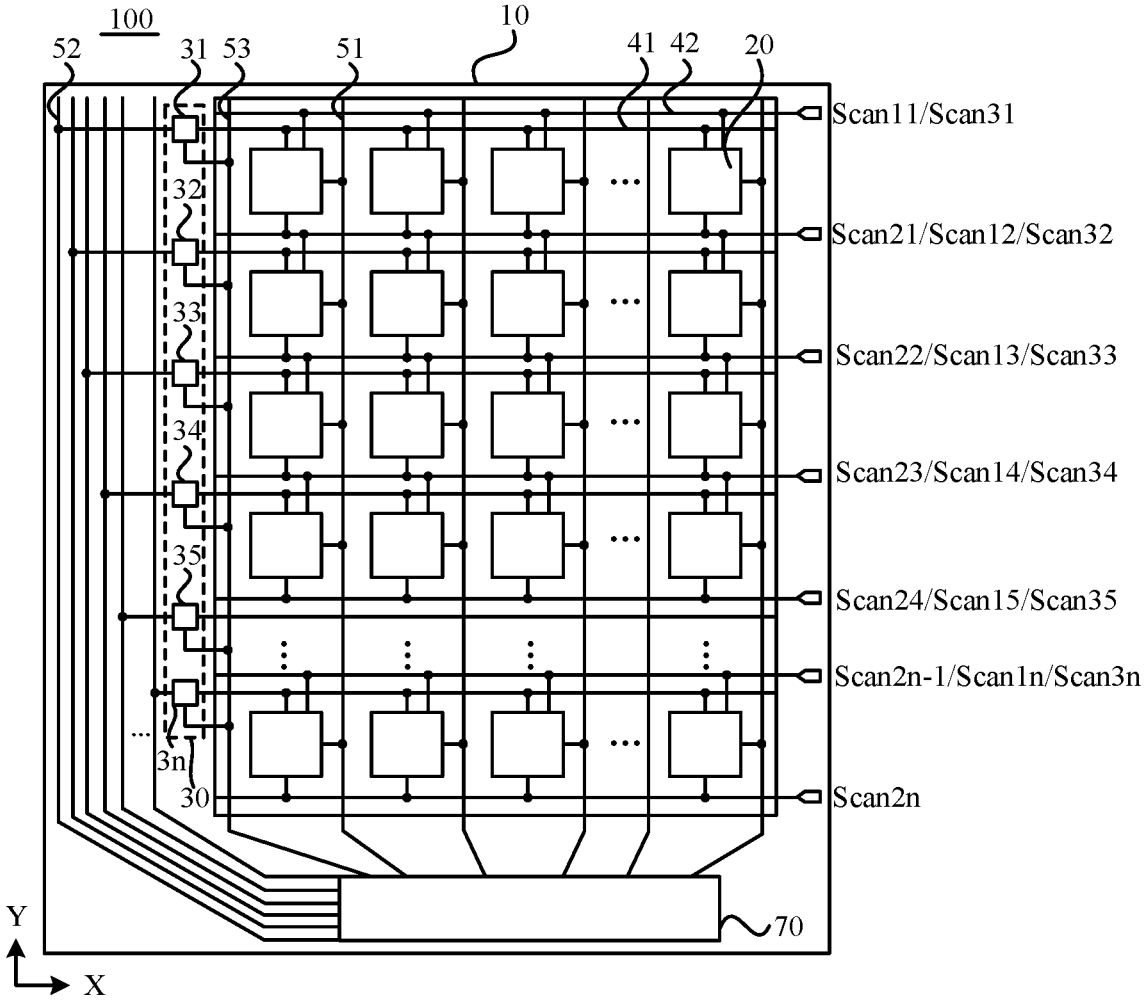
FIG. 8 is a block diagram of another display panel according to an embodiment of the present disclosure.

Exemplarily, FIG. 8 is a block diagram of another display panel according to an embodiment of the present disclosure. As shown in FIG. 8, multiple initialization signal lines 40 extending along a row direction X of sub-pixels 20 and arranged along a column direction of the sub-pixels 20 are further disposed on the one side of the substrate 10 in the display panel 100, and a same row of sub-pixels 20 may use a same initialization signal line 41 in common. Then, when the display panel 100 includes N rows of sub-pixels, there will be N signal conversion circuit 30 disposed in the display panel 100, each signal conversion circuit (31, 32, 33, 34, 35, . . . , and 3*n*) may be electrically connected to a respective initialization signal line 41, so that the first initialization signal or the second initialization signal outputted by each signal conversion circuit (31, 32, 33, 34, 35, . . . , and 3*n*) may be transmitted to second electrodes of initialization transistors of sub-pixels in a respective row through a corresponding initialization signal line 41. Thus, when a signal conversion circuit (31, 32, 33, 34, 35, . . . , and 3*n*) outputs the first initialization signal and initialization transistors of sub-pixels 20 in the corresponding row are turned on, driving transistors of the sub-pixels in the corresponding row may be initialized, and when the signal conversion circuit (31, 32, 33, 34, 35, . . . , and 3*n*) outputs the second initialization signal and light-emitting elements of the sub-pixels 20 in the corresponding row emit light, the voltage difference between the second electrodes of the initialization transistors and gates of the driving transistors of the sub-pixels in the corresponding row can be kept within the second preset range, thereby reducing a leakage current and improving the display effect of the display panel.

Additionally, when the pixel driving circuit of each sub-pixel in the display panel is the pixel driving circuit shown in FIG. 5, the display panel shown in FIG. 8 may further include multiple scanning signal lines 42, multiple data signal lines 51, multiple data-control-signal transmission lines 54, an initialization signal transmission line 53 and multiple signal pins 70. For the similarities between FIGS. 8 and 6, refer to the preceding description of FIG. 6. Only the differences between FIGS. 8 and 6 are exemplarily described here. In this case, as shown in FIG. 8, an input end of each signal conversion circuit (31, 32, 33, 34, 35, . . . , and 3*n*) may receive the initialization signal through the initialization signal transmission line 53, and a control end of the each signal conversion circuit (31, 32, 33, 34, 35, . . . , and 3*n*) may receive a data control signal through a respective data-control-signal transmission line 54. The initialization signal transmission line 53 and the multiple data signal lines 51 may be formed in a same fabrication process by using a same material, so as to simplify the fabrication process of the display panel 100, reduce the costs of the display panel 100, and facilitate the thinning of the display panel.

Accordingly, taking the pixel driving circuit shown in FIG. 5 as an example, the driving timing of each row of sub-pixels in the display panel shown in FIG. 8 includes an initialization stage, a data writing stage and a light-emitting stage.

Figure 9:
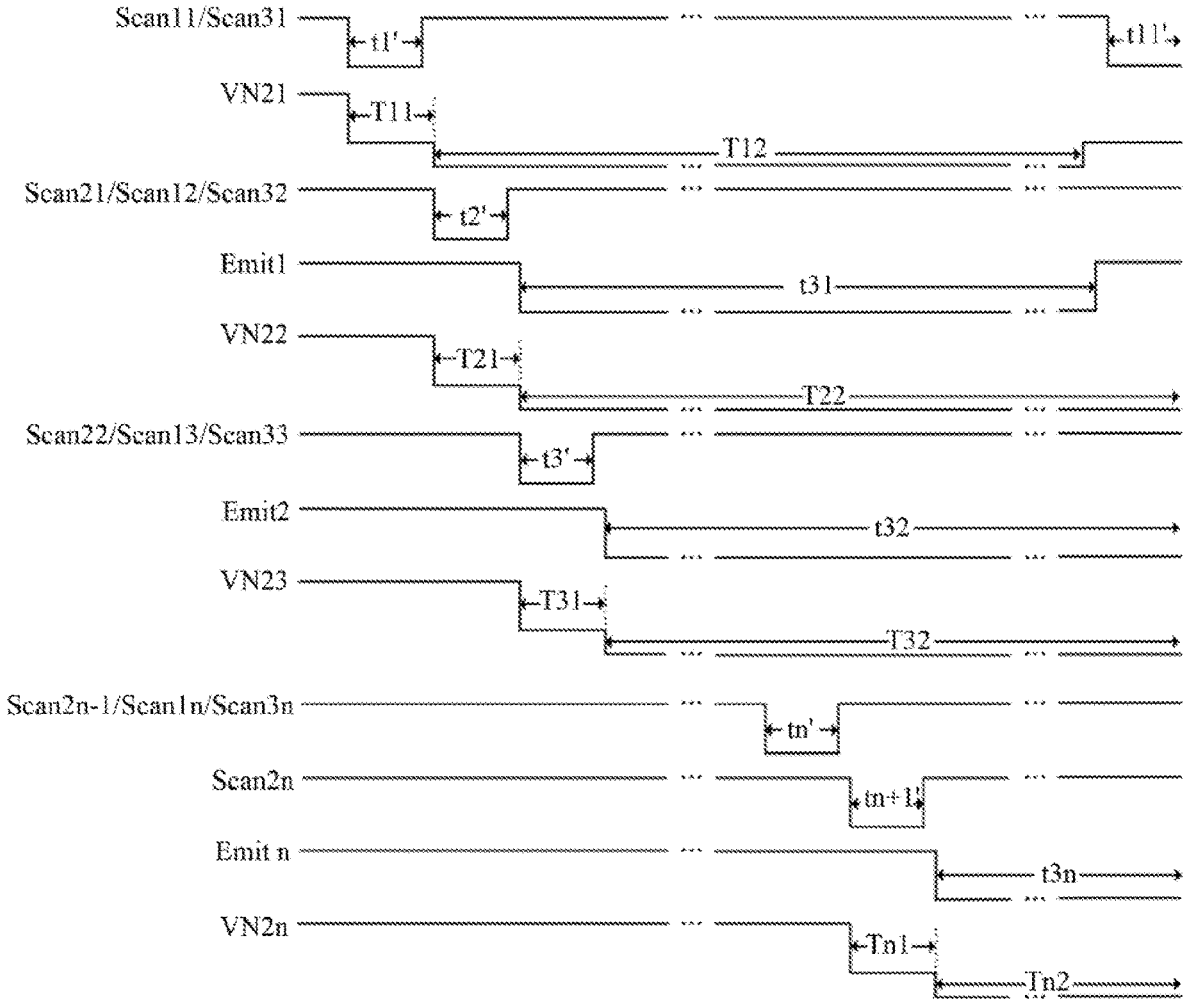
FIG. 9 is a driving timing diagram of a display panel corresponding to FIG. 8.

Exemplarily, FIG. 9 is a driving timing diagram of a display panel corresponding to FIG. 8. In conjunction with FIGS. 5, 8 and 9, in an initialization stage t1' of a first row of sub-pixels, initialization transistors M1 of the sub-pixels in the first row are turned on under the control of a first scanning signal Scant 1 transmitted by the corresponding scanning signal line 42, a signal conversion circuit 31 converts the initialization signal transmitted by the initialization signal transmission line 53 to a first initialization signal VN21, and transmits the first initialization signal VN21 to gates N1 of driving transistors T through the turned-on initialization transistors M1 to initialize the driving transistors T. In a data writing stage t2' of the first row of sub-pixels, the initialization transistors M1 of the sub-pixels in the first row are turned off, and data writing transistors M2 and threshold compensation transistors M3 of the sub-pixels in the first row are turned on under the control of a second scanning signal Scan21 transmitted by the corresponding scanning signal line 42, so that the data signal received by first electrodes of the data writing transistors M2 are written into the gates of the driving transistors T; and at the same time, the control end of the signal conversion circuit 31 receives a data control signal through a corresponding data-control-signal transmission line 52, where the data control signal may be obtained according to the data signal written into the gate of the driving transistor T of each sub-pixel in the first row, so that the second initialization signal VN21 converted by the signal conversion circuit 31 according to the data control signals received by the signal conversion circuit 31 is transmitted to the second electrodes N2 of the initialization transistors M1 of the sub-pixels in the first row through the corresponding initialization signal line 41. In a light-emitting stage t31 of the first row of sub-pixels, the initialization transistors M1, the data writing transistors M2 and the threshold compensation transistors M3 of the sub-pixels in the first row are all turned off, first light-emitting control transistors M4 and second light-emitting control transistors M5 of the sub-pixels in the first row are turned on under the control of the light-emitting control signal Emit1, so that the driving currents generated by the driving transistors T according to the data signal written into the gates N1 of the driving transistors T can be provided to the light-emitting elements 22 and control the light-emitting elements 22 to emit light; and at this time, the second initialization signal VN21 outputted by the signal conversion circuit 31 to the second electrodes N2 of the initialization transistors M1 of the sub-pixels in the first row can keep the voltage difference between the second electrodes N2 of the initialization transistors M1 and the gates N1 of the driving transistors T of the sub-pixels in the first row within the second preset range, so as to reduce a leakage current caused by the voltage difference between the second electrode N2 of the initialization transistor M1 and the gate N1 of the driving transistor T and reduce the impact of the leakage current on the gate potential of the driving transistor T, thereby enabling the light-emitting elements 22 to stably emit light and improving the display effect of the display panel.

Accordingly, the data writing stage t2' of the first row of sub-pixels is also the initialization stage of a second row of sub-pixels. At this time, a signal conversion circuit 32 converts the initialization signal transmitted by the initialization signal transmission line 53 to a first initialization signal VN22, and transmits the first initialization signal VN22 to gates N1 of driving transistors T through a corresponding initialization signal line 41 and turned-on initialization transistors M1 to initialize the driving transistors T of a second row of sub-pixels. The data writing stage t3' of the second row of sub-pixels is also the initialization stage of a third row of sub-pixels. At this time, the signal conversion circuit 32 converts the initialization signal transmitted by the initialization signal transmission line 53 to a second initialization signal VN22 according to a data control signal received by the control end of the signal conversion circuit 32, and transmits the second initialization signal VN22 to the second electrodes N2 of the initialization transistors M1 of the sub-pixels in the second row; and at the same time, a signal conversion circuit 33 may convert the initialization signal transmitted by the initialization signal transmission line 53 to a first initialization signal, and transmit the first initialization signal into gates N1 of driving transistors T through a corresponding initialization signal line 41 and turned-on initialization transistors M1 to initialize the driving transistors T of the sub-pixels in the third row. At the light-emitting stage t32 of the second row of sub-pixels, driving currents generated by the driving transistors T of the sub-pixels in the second row according to the data signal written into the gates N1 of the driving transistors T may be provided to light-emitting elements 22 to control the light-emitting elements 22 of the sub-pixels in the second row to emit light; and at the same time, the second initialization signal VN22 outputted by the signal conversion circuit 32 to the second electrodes N2 of the initialization transistors M1 of the sub-pixels in the second row can ensure that the voltage difference between the second electrodes N2 of the initialization transistors M1 and the gates N1 of the driving transistors T of the sub-pixels in the second row is within the second preset range. The data control signal received by the control end of the signal conversion circuit 32 may be obtained according to the data signal written into the gates of the driving transistors T of the sub-pixels in the second row.

The rest may be done in the same manner. The data writing stage tn' of the $(N-1)^{th}$ row of sub-pixels is also the initialization stage of the $N^{th}$ row of sub-pixels. At this time, a signal conversion circuit 3*n* converts the initialization signal transmitted by the initialization signal transmission line 53 to a first initialization signal VN2*n*, and transmits the first initialization signal VN2*n* to gates N1 of driving transistors T through a corresponding initialization signal line 41 and turned-on initialization transistors M1 to initialize the driving transistors T of the $N^{th}$ row of sub-pixels. In the data writing stage $tn+1^{th}$ of the $N^{th}$ row of sub-pixels, the signal conversion circuit 3*n* converts the initialization signal transmitted by the initialization signal transmission line 53 to a second initialization signal VN2*n* according to a data control signal received at the control end of the signal conversion circuit 3*n*, and provides the second initialization signal VN2*n* to the second electrodes N2 of the initialization transistors M1 of the sub-pixels in the $N^{th}$ row. In the light-emitting stage t3*n* of the $N^{th}$ row of sub-pixels, driving currents generated by the driving transistors T of the sub-pixels in the $N^{th}$ row according to a data signal written into the gates N1 of the driving transistors T can be provided to light-emitting elements 22 to control the light-emitting elements 22 of the sub-pixels in the $N^{th}$ row to emit light; and at the same time, the second initialization signal VN2*n* outputted by the signal conversion circuit 3*n* to the second electrodes N2 of the initialization transistors M1 of the sub-pixels in the $N^{th}$ row can ensure that the voltage difference between the second electrodes N2 of the initialization transistors M1 and the gates N1 of the driving transistors T of the sub-pixels in the $N^{th}$ row is within the second preset range. The data control signal received by the control end of the signal conversion circuit 3*n* may be obtained according to the data signal written into the gates of the driving transistors T of the sub-pixels in the $N^{th}$ row.

In this embodiment, the initialization stage t1' of the first row of sub-pixels is a stage T11 in which the signal conversion circuit 31 outputs the first initialization signal, and the data writing stage t2' of the first row of sub-pixels and the light-emitting stage t31 of the first row of sub-pixels are both a stage T12 in which the signal conversion circuit 31 outputs the second initialization signal; the initialization stage t2' of the second row of sub-pixels is a stage T21 in which the signal conversion circuit 32 outputs the first initialization signal, and the data writing stage t3' of the second row of sub-pixels and the light-emitting stage t32 of the second row of sub-pixels are both a stage T22 in which the signal conversion circuit 32 outputs the second initialization signal; and so on. The initialization stage tn' of the $N^{th}$ row of sub-pixels is a stage Tn1 in which the signal conversion circuit 3*n* outputs the first initialization signal, and the data writing stage $tn+1^{th}$ of the $N^{th}$ row of sub-pixels and the light-emitting stage t3*n* of the $N^{th}$ row of sub-pixels are both a stage Tn2 in which the signal conversion circuit 3*n* outputs the second initialization signal. In this way, in the light-emitting stage of each row of sub-pixels, the voltage difference between the second electrodes N2 of the initialization transistors M1 and the gates of the driving transistors T of the sub-pixels in each row can be ensured to keep within the second preset range. Moreover, since the data control signal received by the control end of each signal conversion circuit (31, 32, 33, 34, 35, . . . , and 3*n*) is related to the data signal of the sub-pixels 20 in the corresponding row, the voltage difference between the second electrodes N2 of the initialization transistors M1 and the gates of the driving transistors T of the sub-pixels in each row can be accurately controlled, thereby improving the display effect of the display panel.

It is to be noted that the driving timing of the display panel shown in FIG. 9 is only exemplary driving timing of the embodiments of the present disclosure. When only one signal conversion circuit 30 is disposed in the display panel 100, the start time of the data writing stage of each row is served as the time when the signal conversion circuit corresponding to each row of sub-pixels starts to output the second initialization signal in FIG. 9. However, in the embodiments of the present disclosure, the time when each signal conversion circuit 30 starts to output the second initialization signal may be any time between the end time of the initialization stage of the corresponding row of sub-pixels and the start time of the light-emitting stage of the corresponding row of sub-pixels, which is not limited in the embodiments of the present disclosure.

Figure 10:
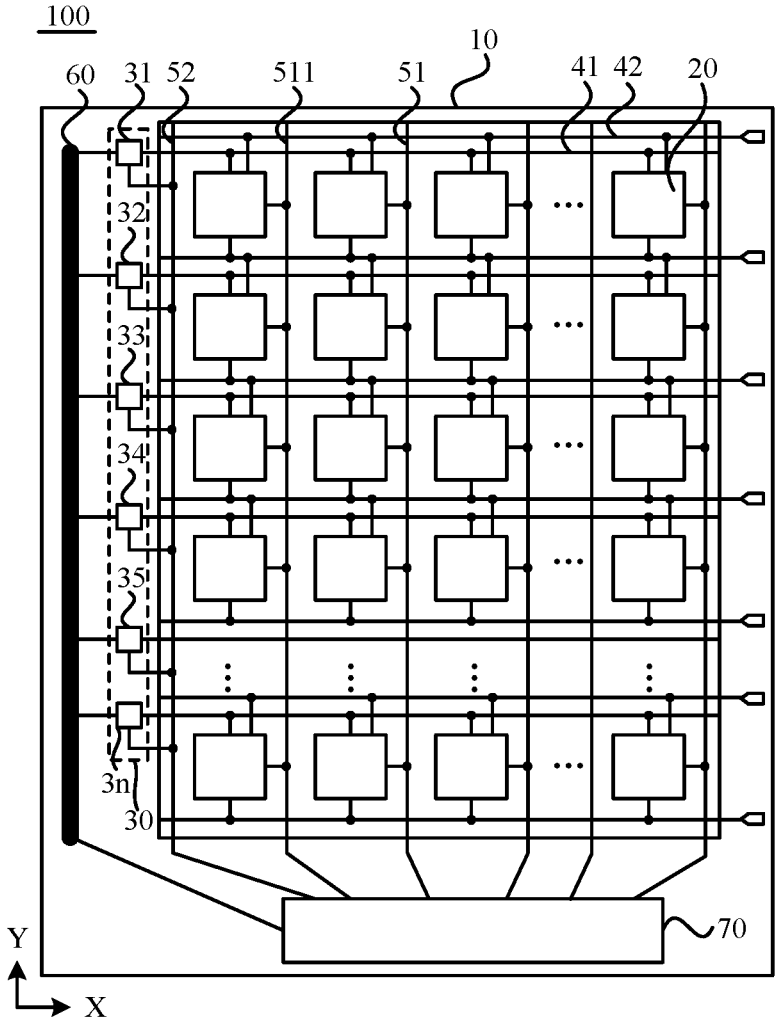
FIG. 10 is a block diagram of another display panel according to an embodiment of the present disclosure.

Alternatively, FIG. 10 is a block diagram of another display panel according to an embodiment of the present disclosure. For the similarities between FIGS. 10 and 8, please refer to the preceding descriptions of FIG. 8. Only the differences between FIGS. 10 and 8 are exemplarily described here. As shown in FIG. 10, a data control line 52 located on the one side of the substrate extends along a column direction Y, the data control line 52 may transmit a data control signal to the control end of each signal conversion circuit (31, 32, 33, 34, 35, . . . , and 3*n*). Accordingly, a corresponding initialization signal bus 60 may further be disposed in the display panel. The initialization signal bus 60 may transmit the initialization signal to the input end of each signal conversion circuit (31, 32, 33, 34, 35, . . . , and 3*n*).

Thus, each signal conversion circuit (31, 32, 33, 34, 35, . . . , and 3*n*) outputs a first initialization signal during the period from the start time of the initialization stage of the first row of sub-pixels to the end time of the initialization stage of the $N^{th}$ row of sub-pixels, while each signal conversion circuit (31, 32, 33, 34, 35, . . . , and 3*n*) may output a second initialization signal during the period from the end time of the initialization stage of the $N^{th}$ row of sub-pixels to the restart time of the initialization stage of the first row of sub-pixels, so that the voltage difference between second electrodes of initialization transistors M1 and gates of driving transistors T of sub-pixels in each row can be ensured to be within the second preset range at least when all rows of sub-pixels are in the light-emitting stage, so as to reduce a leakage current caused by the voltage difference between the second electrodes N2 of the initialization transistors M1 and the gates of the driving transistor T, thereby enabling light-emitting elements 22 of the sub-pixels in each row to stably emit light and improving the display effect of the display panel.

It is to be noted that when each signal conversion circuit shown in FIG. 10 receives the data control signal through a same data control line, the driving timing may be similar to the technical principle in the case where only one signal conversion circuit is disposed in the display panel. For the similarities, refer to the preceding descriptions of the case where only one signal conversion circuit is disposed in the display panel, which will not be repeated here.

Alternatively, still referring to FIG. 10, when multiple data signal lines 51 are further disposed on the one side of the substrate 10 in the display panel, the data control line 52 and the multiple data signal lines 51 may be arranged along the row direction X of sub-pixels 20, and each data signal line 51 extends along the column direction of the sub-pixels 20. In this time, a same column of sub-pixels 20 may use a same data signal line 51, so that each data signal line 51 may transmit a data signal to corresponding sub-pixels. The data control line 52 and the multiple data signal lines 51 may be formed in a same fabrication process by using a same material, so as to simplify the fabrication process of the display panel 100, reduce the costs of the display panel 100, and facilitate the thinning of the display panel.

Additionally, for the display panel in the related art, to simplify the fabrication manner, same signal lines are disposed on two opposite sides of each sub-pixel. For example, corresponding data signal lines are disposed on both sides of each column of sub-pixels, and when each column of sub-pixels are all electrically connected to data signal lines located on the same side of the each column of sub-pixels, there will be redundant data signal lines. Since these redundant data signal lines do not transmit signals, there is the risk of static electricity accumulation in a long term, thus affecting the display effect of the display panel.

The data control line 52 shown in FIG. 10 of the embodiments of the present disclosure may be regarded as a redundant data signal line in the related art. At this time, when a data signal line 51 adjacent to the data control line is a first data signal line 511 and a column of sub-pixels adjacent to an edge of the substrate is a first column of sub-pixels, the first data signal line 511 may be electrically connected to the first column of sub-pixels, the data control line 52 and the first data signal line 511 are located on two opposite sides of the first column of sub-pixels, and the data control line 52 may be located on one side of the first column of sub-pixels adjacent to the edge of the substrate 10. Thus, since the data control line 52 may transmit the data control signal to each signal conversion circuit (31, 32, 33, 34, 35, . . . , and 3*n*), the static electricity accumulation can be prevented, thereby improving the display effect of the display panel 100.

Figure 11:
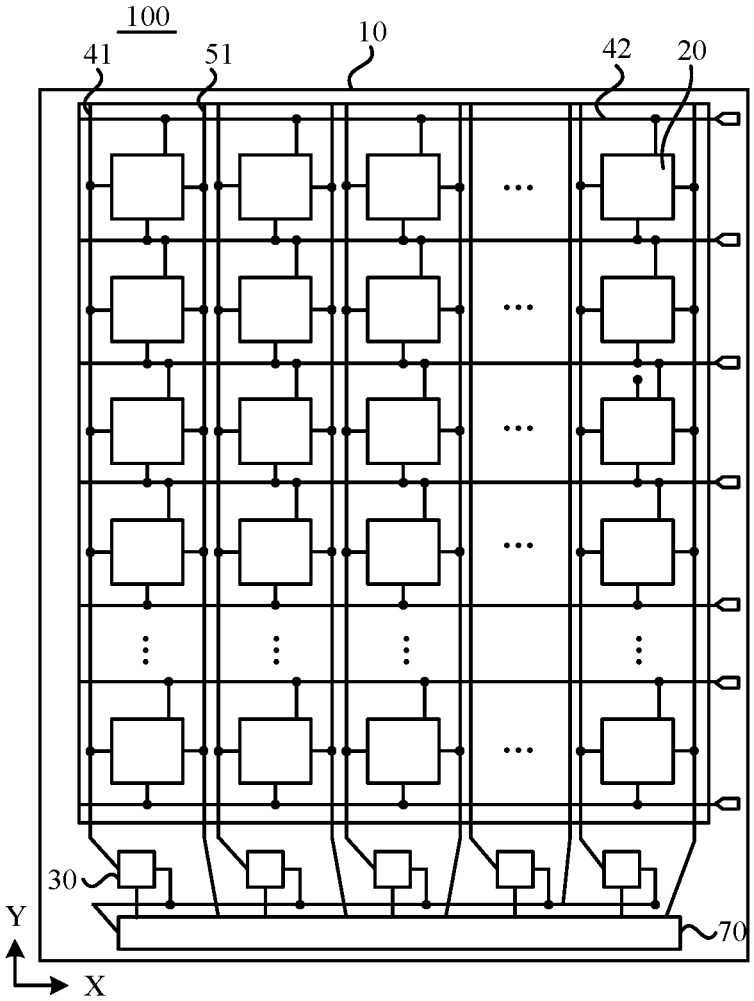
FIG. 11 is a block diagram of another display panel according to an embodiment of the present disclosure.

Alternatively, FIG. 11 is a block diagram of another display panel according to an embodiment of the present disclosure. For the similarities between FIGS. 11 and 10, refer to the preceding description of FIG. 10. Only the differences between FIGS. 11 and 10 are exemplarily described here. As shown in FIG. 11, multiple initialization signal lines 41 disposed on the one side of the substrate 10 in the display panel 100 are arranged along the row direction of sub-pixels 20, and each initialization signal line 41 extends along the column direction of the sub-pixels 20. In this case, second electrodes of initialization transistors of sub-pixels in each column may be electrically connected to an output end of a same signal conversion circuit 30 through a same initialization signal line 41. That is, multiple signal conversion circuits 30 may be disposed in the display panel, so that each signal conversion circuit 30 may correspond to a respective column of sub-pixels, or each signal conversion circuit 30 may correspond to multiple columns of sub-pixels.

Thus, each signal conversion circuit 30 outputs the first initialization signal before the end time of the initialization stage of the respective column of sub-pixels to initialize driving transistors of sub-pixels in the respective column. At least when all columns of sub-pixels are in the light-emitting stage, the second initialization signal outputted by each signal conversion circuit 30 may enable the voltage difference between second electrodes of initialization transistors and gates of the driving transistors T of the sub-pixels in the respective column to be within the second preset range, so as to reduce the leakage current caused by the voltage difference between the second electrodes of the initialization transistors and the gates of the driving transistors, thereby enabling light-emitting elements 22 of the sub-pixels in the each row to stably emit light and further improving the display effect of the display panel.

Figure 12:
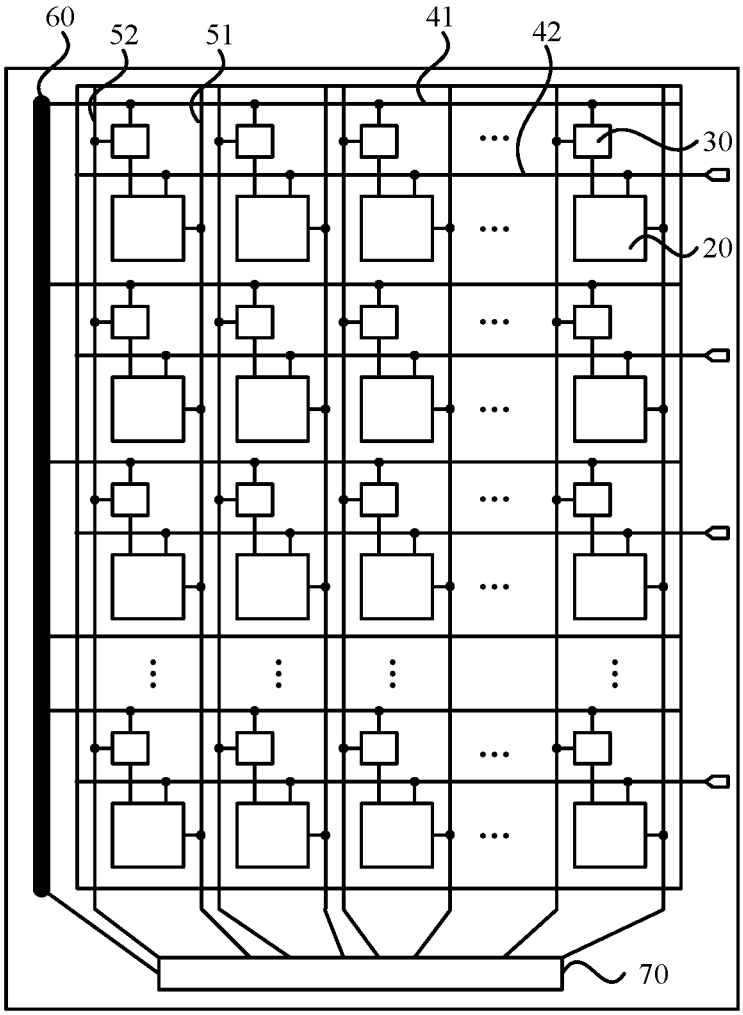
FIG. 12 is a block diagram of another display panel according to an embodiment of the present disclosure.

Alternatively, FIG. 12 is a block diagram of another display panel according to an embodiment of the present disclosure. For the similarities between FIG. 12 and FIG. 11, refer to the preceding description of FIG. 11. Only the differences between FIG. 12 and FIG. 11 are exemplarily described here. As shown in FIG. 12, the display panel 100 includes N*M sub-pixels 20 and N*M signal conversion circuits 30 disposed in a one-to-one correspondence to the N*M sub-pixels, so that the second electrode of the initialization transistor of each sub-pixel 20 is electrically connected to a respective signal conversion circuit 30. At this time, in the initialization stage of a sub-pixel 20, a signal conversion circuit 30 electrically connected to the second electrode of the initialization transistor of the sub-pixel 20 converts an initialization signal to a first initialization signal to initialize a driving transistor of this sub-pixel 20; and in the light-emitting stage of the sub-pixel, the initialization transistor of the sub-pixel is turned off, and the signal conversion circuit 30 electrically connected to the sub-pixel converts the initialization signal to a second initialization signal, and outputs the second initialization signal to the second electrode of the initialization transistor of the sub-pixel, so that the voltage difference between the second electrode of the initialization transistor of the sub-pixel and a gate of the driving transistor of the sub-pixel is within the second preset range, so as to reduce a leakage current caused by the voltage difference between the second electrode of the initialization transistor and the gate of the driving transistor, thereby reducing the impact on the gate potential of the driving transistor and improving the emitting stability of the light-emitting element of the sub-pixel. At the same time, when each sub-pixel is provided with the respective signal conversion circuit, a data control signal received by the control end of each signal conversion circuit may has a one-to-one correspondence to a data signal written into the respective sub-pixel, so that each signal conversion circuit can output a corresponding second initialization signal as regards to the gate potential of the driving transistor in the respective sub-pixel electrically connected to the each signal conversion, thereby the voltage difference between the second electrode of the initialization transistor and the gate of the driving transistor of each pixel can be accurately controlled in the light-emitting stage, and further improving the display effect of the display panel.

Exemplarily, the display panel may further be provided with a data control line 52 for transmitting the data control signal, multiple initialization signal lines 41 for transmitting an initialization signal to the signal conversion circuits 30, and an initialization signal bus 60 for transmitting the initialization signal to each initialization signal line 41. In this case, signal conversion circuits 30 located in a same row may use a same initialization signal line 41 in common, and signal conversion circuits 30 located in a same column may use a same data control signal line 52 in common.

Accordingly, a first capacitor may be further disposed in each sub-pixel, a first end of the first capacitor receives a second fixed voltage signal, and a second end of the first capacitor is electrically connected to the second electrode of the initialization transistor. Thus, when the signal conversion circuit outputs the second initialization signal to the second electrode of the initialization transistor, the second initialization signal may be stored into the first capacitor to maintain the potential of the second electrode of the initialization transistor in the light-emitting stage of the sub-pixel to which the initialization transistor belongs, so that the voltage difference between the second electrode of the initialization transistor of the sub-pixel and the gate of the driving transistor of the sub-pixel is within the second preset range at least in the light-emitting stage of the sub-pixel.

Figure 13:
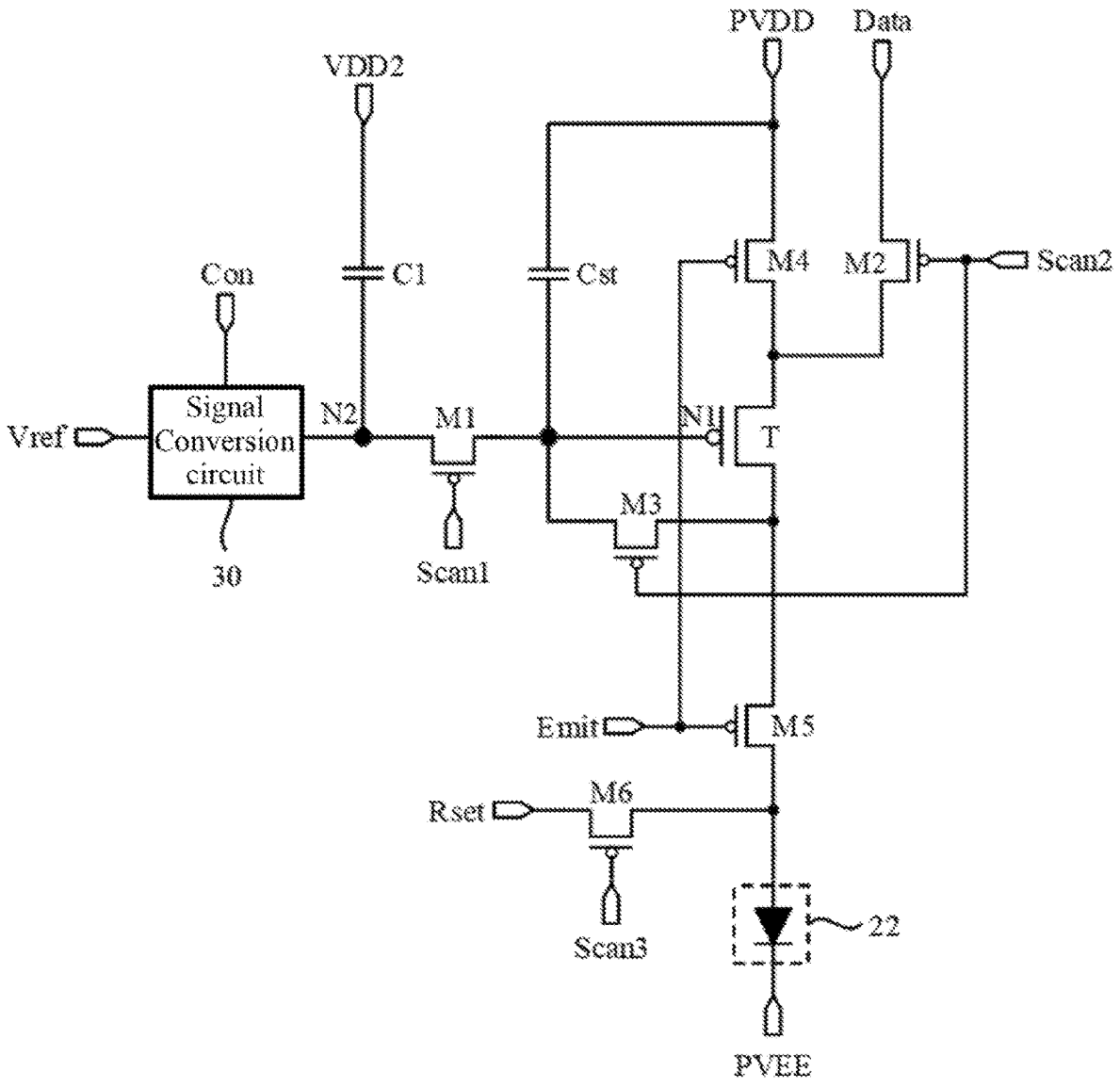
FIG. 13 is a circuit diagram of another sub-pixel according to an embodiment of the present disclosure.

Exemplarily, FIG. 13 is a circuit diagram of another sub-pixel according to an embodiment of the present disclosure. For the similarities between FIG. 13 and FIG. 5, refer to the preceding description of FIG. 5 in [0064]. Only the differences between FIG. 13 and FIG. 5 are exemplarily described here. As shown in FIG. 13, a first end of a first capacitor C1 receives a second fixed voltage signal VDD2, and a second end of the first capacitor C1 is electrically connected to the second electrode N2 of the initialization transistor M1. In this case, when a signal conversion circuit 30 converts an initialization signal Vref to a first initialization signal, the first initialization signal is outputted to the second electrode N2 of the initialization transistor M1 to initialize the first capacitor C1 electrically connected to the second electrode N2 of the initialization transistor M1; and at the same time, the first initialization signal may further be transmitted to the gate of the driving transistor T and an end of a storage capacitor Cst through the turned-on initialization transistor M1 to initialize the driving transistor T and the storage capacitor Cst. When the signal conversion circuit 30 converts the initialization signal Vref to a second initialization signal according to a data control signal Con received by the control end of the signal conversion circuit 30, the second initialization signal is outputted to the second electrode N2 of the initialization transistor M1 and stored in the first capacitor C1 electrically connected to the second electrode N2 of the initialization transistor M1, so that the voltage difference between the second electrode N2 of the initialization transistor M1 and the gate of the driving transistor T can be maintained within the second preset range during the whole process where the driving transistor T provides a driving current to the light-emitting element 22 to enable the light-emitting element 22 to emit light.

In order to form a corresponding loop when the driving transistor T provides the driving current to the light-emitting element, a first electrode of the driving transistor T is further directly or indirectly electrically connected to a first power source. A voltage signal of the first power source is a first power voltage signal PVDD. In this case, a second fixed voltage signal VDD2 received by the first end of the first capacitor C1 may be the same as the first power voltage signal PVDD. Thus, it is not necessary to separately set a corresponding signal transmission line for the second fixed voltage signal VDD2, thereby simplifying the structure of the display panel, reducing the number of signal pins in the display panel, and reducing the costs of the display panel.

In the embodiments of the present disclosure, the signal conversion circuit may be composed of multiple active devices and/or passive devices. The structure of the signal conversion circuit is not limited in the embodiments of the present disclosure on the premise that functions of the signal conversion circuit can be implemented. An active device may be, for example, a transistor. A passive device may be, for example, a resistor, a capacitor and the like.

Figure 14:
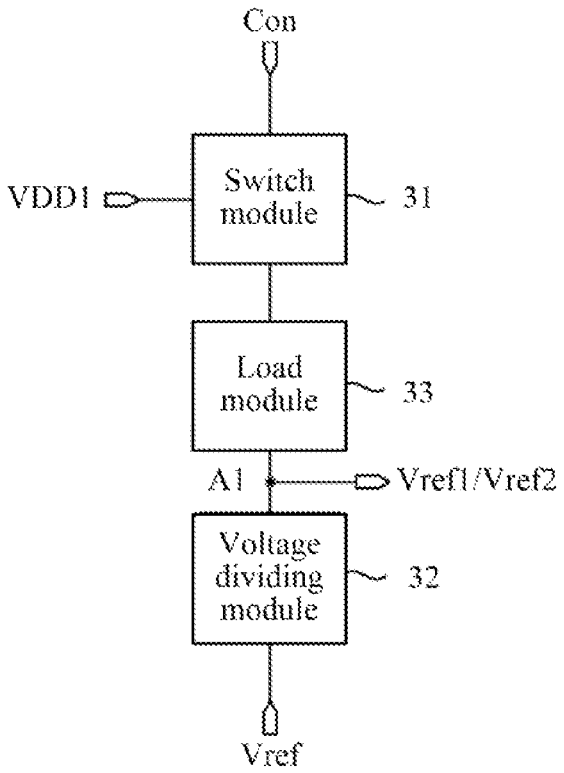
FIG. 14 is a block diagram of a signal conversion circuit according to an embodiment of the present disclosure.

Alternatively, FIG. 14 is a block diagram of a signal conversion circuit according to an embodiment of the present disclosure. As shown in FIG. 14, a signal conversion circuit may include a switch module 31, a voltage dividing module 32 and a load module 33. A control end of the switch module 31 receives the data control signal Con, a first end of the switch module 31 receives a first fixed voltage signal VDD1, and a second end of the switch module 31 is electrically connected to a first end of the load module 33. The switch module 32 is configured to generate a voltage dividing current according to a voltage difference between the data control signal Con and the first fixed voltage signal VDD1. A first end of the voltage dividing module 32 receives the initialization signal Vref, both of a second end of the voltage dividing module 32 and a second end of the load module 33 are electrically connected to a first node A1. The first node A1 is an output end of the signal conversion circuit. The voltage dividing module 32 is configured to divide a voltage of the initialization signal according to the voltage dividing current so that the output end of the signal conversion circuit outputs a first initialization signal Vref1 or a second initialization signal Vref2.

When the data control signal Con and the first fixed voltage signal VDD1 control the switch module 31 to be turned off, the switch module 31 cannot generate the corresponding voltage dividing current. At this time, after directly flowing through the voltage dividing module 32, the initialization signal Vref may output the first initialization signal Vref1 to the second electrode of the initialization transistor of a corresponding sub-pixel, and transmit to the gate of the driving transistor through the turned-on initialization transistor to initialize the driving transistor. When the data control signal Con and the first fixed voltage signal VDD1 control the switch module 31 to be turned on, the turned-on switch module 31 may generate a corresponding voltage dividing current according to the voltage difference between the data control signal Con and the first fixed voltage signal VDD1, and this voltage dividing current may control the value of the voltage difference across the voltage dividing module 32. When the initialization signal Vref has a fixed value, the voltage dividing current may control the potential of the first node A1, that is, to realize the adjustment of the value of the second initialization signal Vref2 outputted by the signal conversion circuit.

Thus, the value of the data control signal inputted into the switch module of the signal conversion circuit may be controlled according to the data signal written into the sub-pixel electrically connected to the signal conversion circuit, so that the switch module generates the corresponding voltage dividing current, and the potential of the first node may be adjusted while the voltage dividing module divides the voltage according to the voltage dividing current, so as to output the corresponding second initialization signal, so that the voltage difference between the second electrode of the initialization transistor and the gate of the driving transistor of the corresponding sub-pixel is within the second preset range.

The switch module in the signal conversion circuit according to the embodiments of the present disclosure may be, for example, a switch transistor. The switch transistor may generate the corresponding voltage dividing current according to the voltage difference between a gate of the switch transistor and a first electrode of the switch transistor. In this case, the gate of the switch transistor may be the control end of the switch module, the first electrode of the switch transistor may be the first end of the switch module, and a second electrode of the switch transistor may be the second end of the switch module. Alternatively, the first electrode of the switch transistor is the control end of the switch module, the gate of the switch transistor is the first end of the switch module, and the second electrode of the switch transistor is the second end of the switch module.

Figure 15:
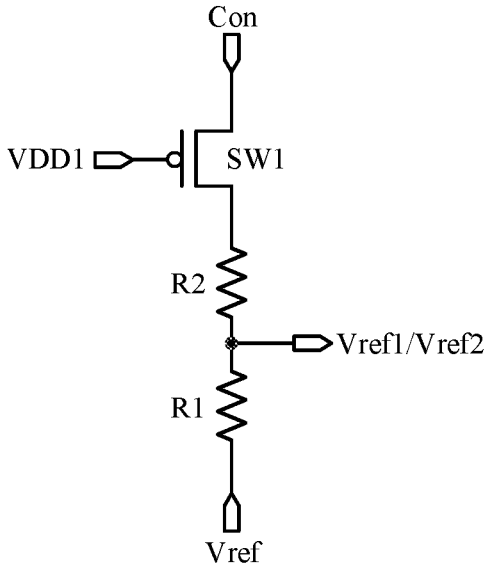
FIG. 15 is a circuit diagram of a signal conversion circuit according to an embodiment of the present disclosure.

Exemplarily, FIG. 15 is a circuit diagram of a signal conversion circuit according to an embodiment of the present disclosure. As shown in FIG. 15, the voltage dividing module of the signal conversion circuit may include a first resistor R1, the load module of the signal conversion circuit may include a second resistor R2, and the switch module includes a switch transistor SW1. When a gate of the switch transistor SW1 is the first end of the switch module, a first electrode of the switch transistor SW1 is the control end of the switch module, and a second electrode of the switch transistor SW1 is the second end of the switch module, a voltage dividing current I generated by the switch transistor SW1 satisfies the equation described below.

$$I=K(Vsg-|Vth|)^2=K(Con-VDD1-|Vth|)^2;$$

Here $$K=\frac{1}{2}*\mu*Cox*\left(\frac{W}{L}\right),$$

μ denotes the mobility constant of carriers in the switch transistor SW1, Cox denotes the channel capacitance per unit area in the switch transistor SW1, $$\frac{W}{L}$$

denotes the channel width-to-length ratio of the switch transistor SW1, and Vth denotes the threshold voltage of the switch transistor SW1. Thus, the switch transistor SW1 may generate the corresponding voltage dividing current by controlling the voltage of the data control signal Con inputted to the gate of the switch transistor SW1, so as to realize the purpose of adjusting the potential of the first node A1 after dividing the voltage by using the first resistor R1, so that when the signal conversion circuit outputs the second initialization signal to the second electrode of the initialization transistor of the corresponding sub-pixel, the voltage difference between the second electrode of the initialization transistor and the gate of the driving transistor of the sub-pixel can be within the second preset range.

Figure 16:
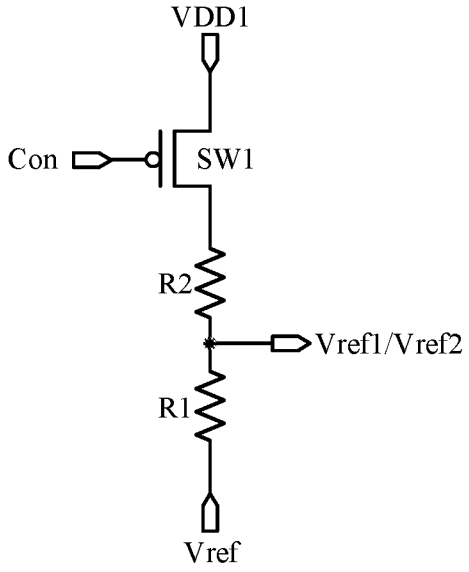
FIG. 16 is a circuit diagram of another signal conversion circuit according to an embodiment of the present disclosure.

Exemplarily, FIG. 16 is a circuit diagram of another signal conversion circuit according to an embodiment of the present disclosure. For the similarities between FIG. 16 and FIG. 15, refer to the preceding description of FIG. 15 in. Only the differences between FIG. 16 and FIG. 15 are exemplarily described here. As shown in FIG. 16, the gate of the switch transistor SW1 is the control end of the switch module, the first electrode of the switch transistor SW1 is the first end of the switch module, and the second electrode of the switch transistor SW2 is the second end of the switch module. In this case, the voltage dividing current I generated by the switch transistor SW1 satisfies the equation described below.

$$I=K(Vsg-|Vth|)^2=K(VDD1-Con-|Vth|)^2.$$

Similarly, the value of the voltage dividing current generated by the switch transistor SW1 may be controlled through controlling the voltage of the data control signal Con inputted into the gate of the switch transistor SW1, so as to realize the purpose of adjusting the potential of the first node A1 after dividing the voltage by using the first resistor R1, so that when the signal conversion circuit outputs the second initialization signal to the second electrode of the initialization transistor of the corresponding sub-pixel, the voltage difference between the second electrode of the initialization transistor and the gate of the driving transistor of the sub-pixel can be within the second preset range.

Alternatively, referring to FIG. 14 and FIG. 4 in a combination, when the first electrode of the driving transistor T is electrically connected to the first power source PVDD, the first fixed voltage signal VDD1 received by the first end of the switch module 31 may be the same as a first power voltage signal. Thus, it is not necessary to separately set a corresponding signal transmission line for the first fixed voltage signal VDD1, thereby simplifying the structure of the display panel, and reducing the number of signal pins in the display panel and the costs of the display panel.

Figure 17:
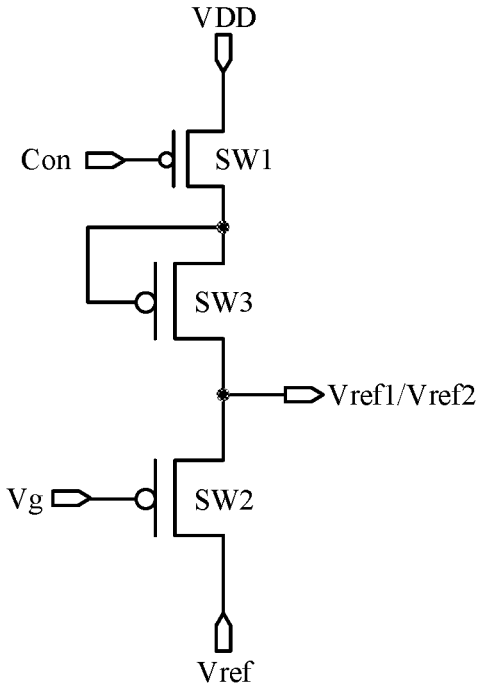
FIG. 17 is a circuit diagram of another signal conversion circuit according to an embodiment of the present disclosure.

Additionally, as shown in FIG. 17, the first resistor of the voltage dividing module in the signal conversion circuit may be replaced by a voltage dividing transistor SW2. The voltage dividing transistor SW2 may be turned on or off under the control of a gate control signal Vg received by a gate of the voltage dividing transistor SW2. The voltage dividing transistor SW2 may have a larger size than the switch transistor SW1 to provide a sufficiently large voltage dividing capability. Meanwhile, the voltage dividing transistor SW2 and the switch transistor SW1 may be formed in a same fabrication process by using a same material, so as to simplify the fabrication process of the display panel and reduce the fabrication costs of the display panel.

Accordingly, still referring to FIG. 17, the second resistor of the load module in the signal conversion circuit may be replaced by a load transistor SW3. The load transistor SW3 may have a larger size than the switch transistor SW1. Meanwhile, the load transistor SW3 and the switch transistor SW1 may be formed in a same fabrication process by using a same material, so as to simplify the fabrication process of the display panel and reduce the fabrication costs of the display panel. Additionally, a gate control signal Vg' received by a gate of the load transistor SW3 may be the same as a scanning signal received by a sub-pixel in the display panel.

Figure 18:
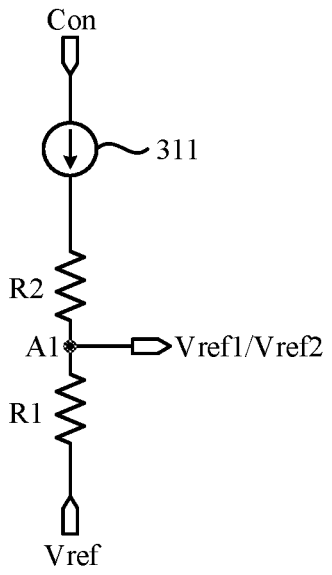
FIG. 18 is a circuit diagram of another signal conversion circuit according to an embodiment of the present disclosure.

Additionally, as shown in FIG. 18, the switch module in the signal conversion circuit may further be replaced by a corresponding current source 311. In this case, the current source 311 may generate a corresponding voltage dividing current according to the data control signal Con inputted by an input end of the current source 311, so as to realize the purpose of adjusting the potential of the first node A1.

Figure 19:
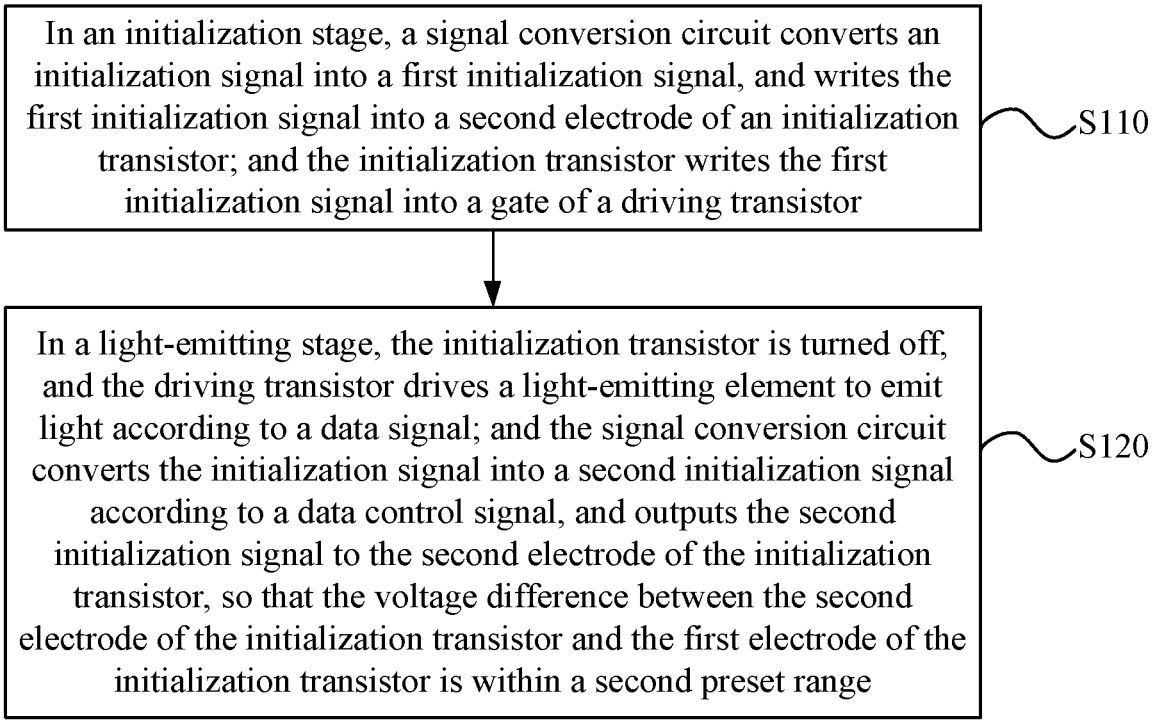
FIG. 19 is a flowchart of a display panel driving method according to an embodiment of the present disclosure.

Based on the same inventive concept, an embodiment of the present disclosure further provides a driving method of a display panel. The driving method of the display panel is applied to the display panel according to the embodiments of the present disclosure. FIG. 19 is a flowchart of a display panel driving method according to an embodiment of the present disclosure. As shown in FIG. 19, the driving method of the display panel includes steps described below.

In S110, in an initialization stage, a signal conversion circuit converts an initialization signal to a first initialization signal, and writes the first initialization signal into a second electrode of an initialization transistor; and the initialization transistor writes the first initialization signal into a gate of a driving transistor.

In S120, in a light-emitting stage, the initialization transistor is turned off, and the driving transistor drives a light-emitting element to emit light according to a data signal; and the signal conversion circuit converts the initialization signal to a second initialization signal according to a data control signal, and outputs the second initialization signal to the second electrode of the initialization transistor, so that the voltage difference between the second electrode of the initialization transistor and the first electrode of the initialization transistor is within a second preset range.

Thus, in the initialization stage, the signal conversion circuit may output the first initialization signal to the second electrode of the initialization transistor, and write the first initialization signal into the gate of the driving transistor through the turned-on initialization transistor to initialize the driving transistor; and in the light-emitting stage, the signal conversion circuit may output the second initialization to the second electrode of the initialization transistor, and since the voltage difference between the data control signal and the data signal written into the gate of the transistor is within a first preset range, the voltage difference between the gate potential of the driving transistor and the second initialization signal converted by the signal conversion circuit according to the data control signal is within the second preset range in the light-emitting stage, so that there is a relatively small voltage difference between the second electrode of the initialization transistor and the gate of the driving transistor, so as to reduce a leakage current caused by the voltage difference between the second electrode of the initialization transistor and the gate of the driving transistor, thereby avoiding an unstable gate voltage of the driving transistor caused by the leakage current, and further improving the display effect.

Figure 20:
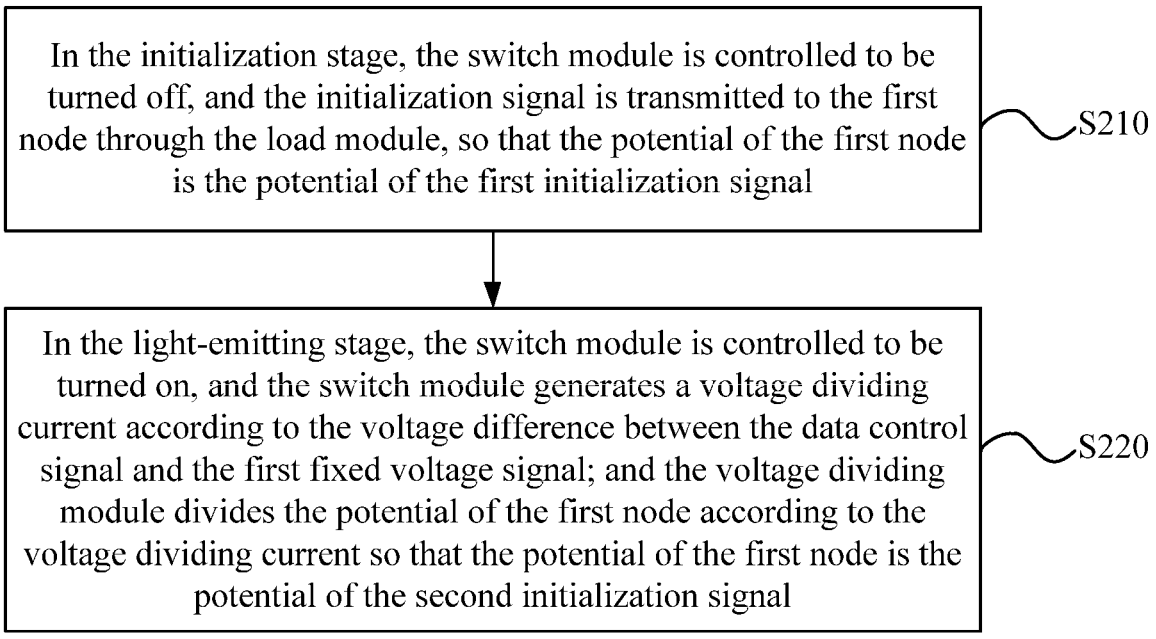
FIG. 20 is a flowchart of another display panel driving method according to an embodiment of the present disclosure.

Alternatively, FIG. 20 is a flowchart of another display panel driving method according to an embodiment of the present disclosure. As shown in FIG. 14, when the signal conversion circuit includes the switch module 31, the voltage dividing module 32 and the load module 33, the control end of the switch module 31 receives the data control signal Con, the first end of the switch module 31 receives the first fixed voltage signal VDD1, the second end of the switch module 31 is electrically connected to the first end of the load module 33, the first end of the voltage dividing module 32 receives the initialization signal Vref, both of the second end of the voltage dividing module 32 and the second end of the load module 33 are electrically connected to the first node A1, and the first node A1 is the output end of the signal conversion circuit, as shown in FIG. 20, the driving method of the display panel includes steps described below.

In S210, in the initialization stage, the switch module is controlled to be turned off, and the initialization signal is transmitted to the first node through the load module, so that the potential of the first node is the potential of the first initialization signal.

In S220, in the light-emitting stage, the switch module is controlled to be turned on, and the switch module generates a voltage dividing current according to the voltage difference between the data control signal and the first fixed voltage signal; and the voltage dividing module divides the potential of the first node according to the voltage dividing current so that the potential of the first node is the potential of the second initialization signal.

Thus, in the initialization stage, the data control signal Con received by the control end of the switch module 31 and the first fixed voltage signal VDD1 received by the first end of the switch module 31 control the switch module 31 to be turned off, the switch module 31 does not generate a corresponding voltage dividing current; and at this time, the initialization signal Vref may be converted to the first initialization signal Vref1 after directly flowing through the voltage dividing module 32, so that the potential of the first node A1 is the potential of the first initialization signal Vref1, so as to output the first initialization signal Vref1 to the second electrode of the initialization transistor of the corresponding sub-pixel, and transmit the first initialization signal Vref1 to the gate of the driving transistor through the turned-on initialization transistor to initialize the driving transistor. In the light-emitting stage, the data control signal Con received by the control end of the switch module 31 and the first fixed voltage signal VDD1 received by the first end of the switch module 31 control the switch module 31 to be turned on, the turned-on switch module 31 may generate the corresponding voltage dividing current according to the voltage difference between the data control signal Con and the first fixed voltage signal VDD1, and this voltage dividing current may control the magnitude of the voltage difference across the voltage dividing module 32. That is, when the initialization signal Vref has a fixed value, the voltage dividing current may control the potential of the first node A1 to adjust the potential of the first node A1 as the potential of the second initialization signal, and transmit the potential of the first node A1 to the second electrode of the initialization transistor electrically connected to the output end of the signal conversion circuit, so that there is a relatively small voltage difference between the second electrode of the initialization transistor and the gate of the driving transistor, so as to reduce a leakage current caused by the voltage difference between the second electrode of the initialization transistor and the gate of the driving transistor, thereby avoiding an unstable gate voltage of the driving transistor caused by the leakage current, and further improving the display effect.

Based on the same inventive concept, an embodiment of the present disclosure further provides a display device. The display device includes the display panel of any embodiment of the present disclosure, so the display device according to the embodiments of the present disclosure has the technical features and beneficial effects of the display panel according to the embodiments of the present disclosure. For similarities, refer to the preceding descriptions of the display panel according to the embodiments of the present disclosure.

Figure 21:
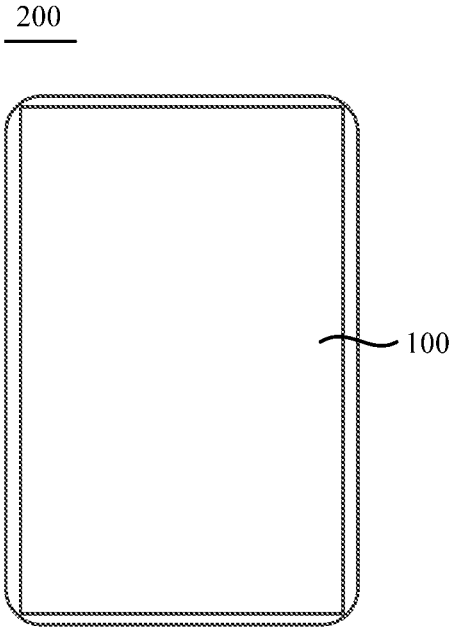
FIG. 21 is a display device according to an embodiment of the present disclosure.

Exemplarily, FIG. 21 is a structural diagram of a display device according to an embodiment of the present disclosure. As shown in FIG. 21, the display device 200 provided by the embodiments of the present disclosure includes the display panel 100 according to the embodiments of the present disclosure. The display device 200 may be, for example, a touch display screen, a mobile phone, a tablet computer, a notebook computer, a television, a wearable device or any electronic device having a display function.

It is to be noted that the above are merely alternative embodiments of the present disclosure and the technical principles used therein. It is to be understood by those skilled in the art that the present disclosure is not limited to the embodiments described herein. Those skilled in the art can make various apparent modifications, adaptations and substitutions without departing from the scope of the present disclosure. Therefore, while the present disclosure has been described in detail through the preceding embodiments, the present disclosure is not limited to the preceding embodiments and may further include more other equivalent embodiments without departing from the concept of the present disclosure. The scope of the present disclosure is determined by the scope of the appended claims.

What is claimed is:

1. A display panel, comprising:

a substrate;

a plurality of sub-pixels located on one side of the substrate, wherein the plurality of sub-pixels are arranged in an array, wherein each of the plurality of sub-pixels comprises a pixel driving circuit and a light-emitting element, wherein the pixel driving circuit comprises an initialization transistor and a driving transistor, wherein a first electrode of the initialization transistor is electrically connected to a gate of the driving transistor, and wherein the driving transistor is configured to provide a driving current to the light-emitting element according to a data signal; and at least one signal conversion circuit, wherein an input end of each of the at least one signal conversion circuit receives an initialization signal, a control end of each of the at least one signal conversion circuit receives a data control signal, and an output end of each of the at least one signal conversion circuit is electrically connected to a second electrode of the initialization transistor;

wherein the at least one signal conversion circuit is configured to: convert the initialization signal to a first initialization signal, or convert, according to the data control signal, the initialization signal to a second initialization signal, and generate an output of the conversion to the second electrode of the initialization transistor;

wherein a voltage difference between the data control signal and the data signal is within a first preset range, and a voltage difference between the second initialization signal and a gate potential of the driving transistor is within a second preset range;

wherein each of the at least one signal conversion circuit comprises a switch module, a voltage dividing module and a load module;

wherein a control end of the switch module receives the data control signal, a first end of the switch module receives a first fixed voltage signal, and a second end of the switch module is electrically connected to a first end of the load module; and the switch module is configured to generate a voltage dividing current according to the voltage difference between the data control signal and the first fixed voltage signal; and a first end of the voltage dividing module receives the initialization signal, both of a second end of the voltage dividing module and a second end of the load module are electrically connected to a first node, wherein the first node is the output end of each of the at least one signal conversion circuit; and wherein the voltage dividing module is configured to divide a voltage of the initialization signal according to the voltage dividing current, so that the output end of each of the at least one signal conversion circuit outputs the first initialization signal or the second initialization signal.

2. The display panel of claim 1, wherein the switch module comprises a switch transistor;

wherein a gate of the switch transistor is the control end of the switch module, a first electrode of the switch transistor is the first end of the switch module, and a second electrode of the switch transistor is the second end of the switch module.

3. The display panel of claim 1, wherein the switch module comprises a switch transistor;

a first electrode of the switch transistor is the control end of the switch module, a gate of the switch transistor is the first end of the switch module, and a second electrode of the switch transistor is the second end of the switch module.

4. The display panel of claim 1, wherein the voltage dividing module comprises a first resistor and the load module comprises a second resistor.

5. The display panel of claim 1, wherein a first electrode of the driving transistor is electrically connected to a first power source; and wherein the first fixed voltage signal is a voltage signal of the first power source.

6. The display panel of claim 1, further comprising:

a plurality of initialization signal lines located on the one side of the substrate, wherein the plurality of initialization signal lines is arranged in parallel along a column direction, and each of the plurality of initialization signal lines extends along a row direction; and wherein second electrodes of the initialization transistors of each row of the plurality of sub-pixels are electrically connected to an output end of a same one of the at least one signal conversion circuit through a same one of the plurality of initialization signal lines.

7. The display panel of claim 6, further comprising:

a data control line located on the one side of the substrate; wherein the data control line extends along the column direction, and the data control line is configured to transmit the data control signal to the at least one signal conversion circuit.

8. The display panel of claim 7, further comprising:

a plurality of data signal lines located on the one side of the substrate;

wherein the data control line and the plurality of data signal lines are formed in a same fabrication process by using a same material; and wherein the data control line and the plurality of data signal lines are arranged along the row direction, each of the plurality of data signal lines extends along the column direction;

wherein a same column of the plurality of sub-pixels uses a same one of the plurality of data signal lines in common, and the plurality of data signal lines are configured to transmit data signals to the plurality of sub-pixels.

9. The display panel of claim 8, wherein one of the plurality of data signal lines adjacent to the data control line is a first data signal line, and a first column of the sub-pixels is disposed at an edge of the substrate; and wherein the first data signal line is electrically connected to the first column of the sub-pixels, the data control line and the first data signal line are separately located on two opposite sides of the first column of the sub-pixels, and wherein the data control line is located on a side of the first column of the sub-pixels at the edge of the substrate.

10. The display panel of claim 1, further comprising:

a plurality of initialization signal lines located on the one side of the substrate;

wherein the plurality of initialization signal lines is arranged in parallel along a row direction, and each of the plurality of initialization signal lines extends along a column direction; and wherein second electrodes of initialization transistors of each column of the plurality of sub-pixels are electrically connected to an output end of a same one of the at least one signal conversion circuit through a same one of the plurality of initialization signal lines.

11. The display panel of claim 1, wherein the second electrode of the initialization transistor of each of the plurality of sub-pixels is electrically connected to a respective one of the at least one signal conversion circuit.

12. The display panel of claim 11, wherein each of the plurality of sub-pixels further comprises a first capacitor;

wherein a first end of the first capacitor receives a second fixed voltage signal, and a second end of the first capacitor is electrically connected to the second electrode of the initialization transistor.

13. The display panel of claim 12, wherein a first electrode of the driving transistor is electrically connected to a first power source; and wherein the second fixed voltage signal is a voltage signal of the first power source.

14. A method of driving the display panel of claim 1, comprising:

using, in an initialization stage, each of the at least one signal conversion circuit to convert the initialization signal to the first initialization signal, and to write the first initialization signal into the second electrode of the initialization transistor; and using the initialization transistor to write the first initialization signal into the gate of the driving transistor;

turning off, in a light-emitting stage, the initialization transistor, driving, by the driving transistor according to the data signal, the light-emitting element to emit light;

converting, by each of the at least one signal conversion circuit, the initialization signal to the second initialization signal according to the data control signal, and outputting the second initialization signal to the second electrode of the initialization transistor, so that the voltage difference between the second electrode of the initialization transistor and the first electrode of the initialization transistor is within the second preset range.

15. The method of claim 14, further comprising:

controlling, in the initialization stage, a switch module comprised in each of the at least one signal conversion circuit to be turned off;

transmitting the initialization signal received by a first end of a voltage dividing module comprised in each of the at least one signal conversion circuit to a first node through a load module in each of the at least one signal conversion circuit so that a potential of the first node is a potential of the first initialization signal, wherein both of a second end of the voltage dividing module and a second end of the load module are electrically connected to the first node, and the first node is the output end of each of the at least one signal conversion circuit; and controlling, in the light-emitting stage, the switch module to be turned on, generating, by the switch module, a voltage dividing current according to a voltage difference between the data control signal received by a control end of the switch module and a first fixed voltage signal received by a first end of the switch module; and dividing, by the voltage dividing module, the potential of the first node according to the voltage dividing current so that the potential of the first node is a potential of the second initialization signal.

16. A display device, comprising a display panel, wherein the display panel comprises:

a substrate;

a plurality of sub-pixels located on one side of the substrate, wherein the plurality of sub-pixels are arranged in an array, wherein each of the plurality of sub-pixels comprises a pixel driving circuit and a light-emitting element, wherein the pixel driving circuit comprises an initialization transistor and a driving transistor, a first electrode of the initialization transistor is electrically connected to a gate of the driving transistor, and the driving transistor is configured to provide a driving current to the light-emitting element according to a data signal; and at least one signal conversion circuit, wherein an input end of each of the at least one signal conversion circuit receives an initialization signal, a control end of each of the at least one signal conversion circuit receives a data control signal, and an output end of each of the at least one signal conversion circuit is electrically connected to a second electrode of the initialization transistor;

wherein the at least one signal conversion circuit is configured to: convert the initialization signal to a first initialization signal or convert, according to the data control signal, the initialization signal to a second initialization signal, and generate an output of the conversion to the second electrode of the initialization transistor;

wherein a voltage difference between the data control signal and the data signal is within a first preset range, and a voltage difference between the second initialization signal and a gate potential of the driving transistor is within a second preset range;

wherein each of the at least one signal conversion circuit comprises a switch module, a voltage dividing module and a load module;

wherein a control end of the switch module receives the data control signal, a first end of the switch module receives a first fixed voltage signal, and a second end of the switch module is electrically connected to a first end of the load module; and the switch module is configured to generate a voltage dividing current according to the voltage difference between the data control signal and the first fixed voltage signal; and a first end of the voltage dividing module receives the initialization signal, both of a second end of the voltage dividing module and a second end of the load module are electrically connected to a first node, wherein the first node is the output end of each of the at least one signal conversion circuit; and wherein the voltage dividing module is configured to divide a voltage of the initialization signal according to the voltage dividing current so that the output end of each of the at least one signal conversion circuit outputs the first initialization signal or the second initialization signal.

17. A display panel, comprising:

a substrate, a plurality of sub-pixels located on one side of the substrate, wherein the plurality of sub-pixels are arranged in an array, wherein each of the plurality of sub-pixels comprises a pixel driving circuit and a light-emitting element, wherein the pixel driving circuit comprises an initialization transistor and a driving transistor, wherein a first electrode of the initialization transistor is electrically connected to a gate of the driving transistor, and wherein the driving transistor is configured to provide a driving current to the light-emitting element according to a data signal; and at least one signal conversion circuit, wherein an input end of each of the at least one signal conversion circuit receives an initialization signal, a control end of each of the at least one signal conversion circuit receives a data control signal, and an output end of each of the at least one signal conversion circuit is electrically connected to a second electrode of the initialization transistor;

wherein the at least one signal conversion circuit is configured to; convert the initialization signal to a first initialization signal, or convert, according to the data control signal, the initialization signal to a second initialization signal, and generate an output of the conversion to the second electrode of the initialization transistor;

wherein a voltage difference between the data control signal and the data signal is within a first preset range, and a voltage difference between the second initialization signal and a gate potential of the driving transistor is within a second preset range;

wherein the display panel further comprising:

a data control line located on the one side of the substrate: wherein the data control line extends along the column direction, and the data control line is configured to transmit the data control signal to the at least one signal conversion circuit.

18. The display panel of claim 17, further comprising;

a plurality of data signal lines located on the one side of the substrate:

wherein the data control line and the plurality of data signal lines are formed in a same fabrication process by using a same material; and wherein the data control line and the plurality of data signal lines are arranged along a row direction, each of the plurality of data signal lines extends along the column direction;

wherein a same column of the plurality of sub-pixels uses a same one of the plurality of data signal lines in common, and the plurality of data signal lines are configured to transmit data signals to the plurality of sub-pixels.

19. A display panel, comprising:

a substrate;

a plurality of sub-pixels located on one side of the substrate, wherein the plurality of sub-pixels are arranged in an array, wherein each of the plurality of sub-pixels comprises a pixel driving circuit and a light-emitting element, wherein the pixel driving circuit comprises an initialization transistor and a driving transistor, wherein a first electrode of the initialization transistor is electrically connected to a gate of the driving transistor, and wherein the driving transistor is configured to provide a driving current to the light-emitting element according to a data signal; and at least one signal conversion circuit, wherein an input end of each of the at least one signal conversion circuit receives an initialization signal, a control end of each of the at least one signal conversion circuit receives a data control signal, and an output end of each of the at least one signal conversion circuit is electrically connected to a second electrode of the initialization transistor;

wherein the at least one signal conversion circuit is configured to; convert the initialization signal to a first initialization signal, or convert, according to the data control signal, the initialization signal to a second initialization signal, and generate an output of the conversion to the second electrode of the initialization transistor;

wherein a voltage difference between the data control signal and the data signal is within a first preset range, and a voltage difference between the second initialization signal and a gate potential of the driving transistor is within a second preset range;

wherein each of the plurality of sub-pixels further comprises a first capacitor;

wherein a first end of the first capacitor receives a second fixed voltage signal, and a second end of the first capacitor is electrically connected to the second electrode of the initialization transistor.

20. The display panel of claim 19, wherein a first electrode of the driving transistor is electrically connected to a first power source; and wherein the second fixed voltage signal is a voltage signal of the first power source.

* * * * *